United States Patent [19]

Drutchas et al.

[11] 4,207,033

[45] Jun. 10, 1980

[54] PUMP AND MOTOR ASSEMBLY FOR USE IN REGULATING A FLOW OF FUEL FROM A SOURCE OF FUEL TO AN OPERATING CHAMBER OF AN ENGINE OF A VEHICLE

[75] Inventors: Gilbert H. Drutchas; Cass, Richard, both of Birmingham; David J. Suttkus, Warren, all of Mich.

[73] Assignee: TRW Inc., Cleveland, Ohio

[21] Appl. No.: 748,061

[22] Filed: Dec. 6, 1976

[51] Int. Cl.[2] ..... F04B 3/00; F04B 17/00

[52] U.S. Cl. ..... 417/251; 417/410; 417/435; 417/540; 418/135

[58] Field of Search ..... 417/251, 435, 286, 410, 417/360, 540, 542, 204; 418/133, 135, 267, 268, 266, 72, 74, 77, 79, 80; 123/139 E

[56] References Cited

U.S. PATENT DOCUMENTS

| | | | |
|---|---|---|---|
| 2,150,347 | 3/1939 | Sorensen | 417/360 |
| 2,309,683 | 2/1943 | Wahlmark | 417/360 |
| 2,311,916 | 2/1943 | Wahlmark | 417/542 |
| 2,312,514 | 3/1943 | Zimmerer | 417/410 |
| 2,919,651 | 1/1960 | Gardiner | 418/79 |
| 2,998,783 | 9/1961 | Lee | 418/77 |
| 3,076,414 | 2/1963 | Adams | 418/82 |
| 3,470,824 | 10/1969 | O'Connor | 418/133 |
| 3,549,288 | 12/1970 | Nichols et al. | 418/133 |
| 3,639,085 | 2/1972 | Bertsch et al. | 417/410 |
| 3,787,151 | 1/1974 | Carlson | 418/133 |
| 3,790,309 | 2/1974 | Volz | 417/410 |
| 3,834,841 | 9/1974 | Falciai et al. | 417/540 |
| 3,900,276 | 8/1975 | Dilworth | 417/542 |

FOREIGN PATENT DOCUMENTS

| | | | |
|---|---|---|---|
| 2423773 | 11/1975 | Fed. Rep. of Germany | 418/268 |
| 495548 | 11/1938 | United Kingdom . | |
| 818534 | 8/1959 | United Kingdom . | |
| 990462 | 4/1965 | United Kingdom | 417/251 |
| 1358135 | 6/1974 | United Kingdom . | |
| 1397598 | 6/1975 | United Kingdom . | |
| 1414172 | 11/1975 | United Kingdom . | |

*Primary Examiner*—Richard E. Gluck

[57] ABSTRACT

An improved pump and motor assembly is utilized to regulate a flow of fuel to an internal combustion engine. All of the fluid connections to the pump are connected with one end of the assembly. The pump and motor are both enclosed within a one-piece casing having a tubular side wall which is integrally formed with an end wall. The end section to which all of the fluid connections for the pump are made, is connected across the open end of the tubular side wall. To provide for the removal of vapor bubbles from the fuel, fuel supplied under pressure from the tank flows through an inlet cavity which circumscribes the pump and has an axial extent which is equal to the length of the pump. In addition, a screen at the inlet of the pump itself blocks the flow of vapor bubbles from the inlet cavity to the pump. The forces applied against opposite sides of the moving components of the pump by the inlet fluid are substantially balanced. Fluid pressure pulses in fuel discharged from the pump are dampened in an outlet cavity by a seal member which sealingly engages an outer cheek plate of the pump to separate the inlet and outlet cavities. A single spring element is utilized to perform the dual functions of pressing the seal member into engagement with the outer cheek plate of the pump and to press the outer cheek plate and cam ring against the inner cheek plate.

49 Claims, 10 Drawing Figures

FIG.5
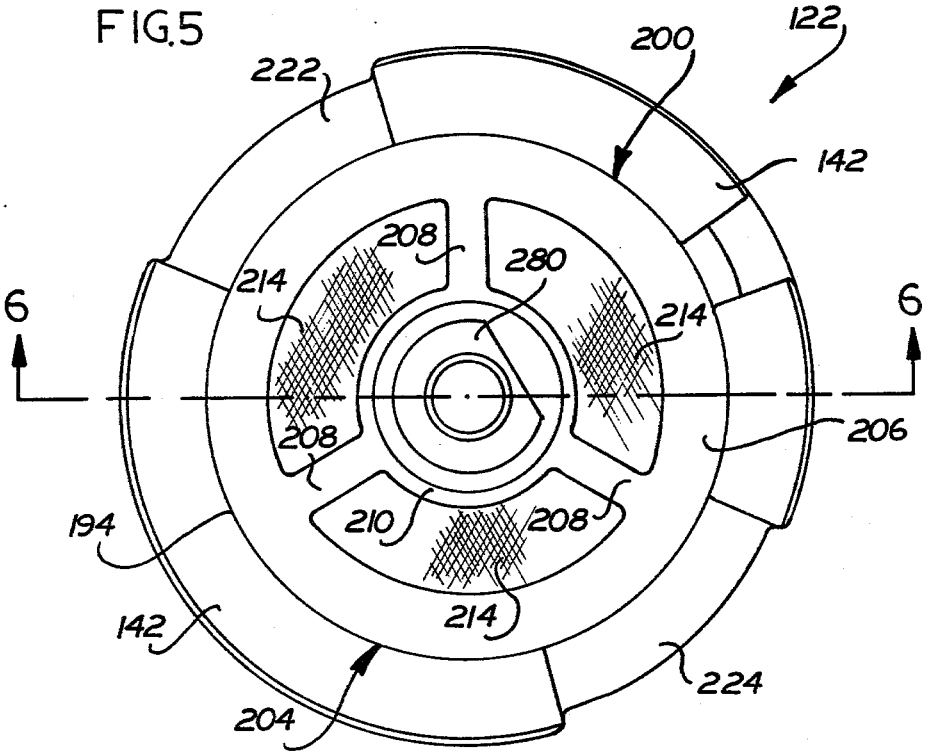
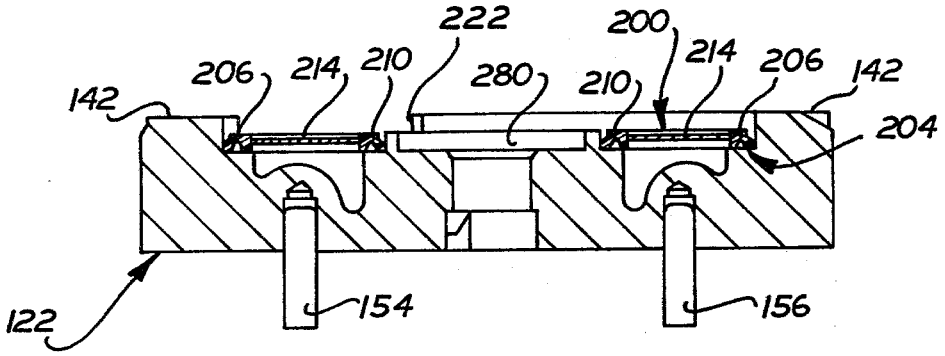
FIG.6

PUMP AND MOTOR ASSEMBLY FOR USE IN REGULATING A FLOW OF FUEL FROM A SOURCE OF FUEL TO AN OPERATING CHAMBER OF AN ENGINE OF A VEHICLE

BACKGROUND OF THE INVENTION

This invention relates generally to a pump and motor assembly which is utilized to regulate the flow of fuel to an engine.

It has been suggested that it would be desirable to provide a fuel distribution system in which a pump is driven by an electric motor having a speed which is controlled in accordance with one or more parameters in a manner similar to that disclosed in U.S. Pat. Nos. 2,687,123; 3,036,564; 3,236,221; 3,470,854; 3,470,858; 3,643,635; 3,817,225; and 3,935,851. If varying the speed of the electric motor is to be effective to provide a desired variation in fuel flow, it is necessary for the fuel discharged from the pump to be free of air. Of course, if vapor bubbles are entrained in the fuel, the rate at which fuel and vapor bubbles discharged from the pump will not provide an accurate measure of the amount of fuel being transmitted to the engine. In addition, it is desirable to avoid pressure peaks which result in irregular fuel flow during operation of the electric motor and fuel pump.

It is desirable to mount the fuel pump and its electric drive motor in close proximity to the engine. This involves locating the pump and motor in extremely cramped quarters. When the pump and motor are to be mounted at such a location, the making of fluid tight connections with the pump is relatively difficult. Yet it is extremely important that these connections be fluid tight since the leakage of fuel onto a hot engine could result in serious problems.

BRIEF SUMMARY OF THE PRESENT INVENTION

The present invention provides a new and improved pump and motor assembly which is utilized to regulate the flow of fuel to an internal combustion engine. This pump and motor assembly is relatively compact and has all of the fluid connections to the pump at one end of the assembly to facilitate mounting of the pump and motor assembly in cramped quarters adjacent to the engine. The possibility of fuel leakage is further minimized by enclosing the pump and motor assembly is a one-piece casing which is connected with an end section to which all of the fluid connections for the pump and motor assembly are made.

During operation of the pump, a flow of fuel in which vapor bubbles may be entrained enters an inlet cavity formed in the casing. Since the vapor bubbles displace fuel, if the vapor bubbles pass through the pump, a given number of operating cycles of the pump will not result in the supplying of a desired quantity of fuel to the engine. Accordingly, any vapor which enters the inlet cavity is returned to the fuel tank in a flow of excess fuel. To promote a flow of the vapor bubbles back to the fuel tank through an excess fuel return conduit, the inlet cavity has a relatively long axial extent so that the vapor bubbles can gravitate upwardly to a top portion of the inlet cavity from which the excess fuel and the air is withdrawn. To further promote the separating of the vapor bubbles from the fuel, a screen is provided at the inlet to the pump. As the fuel flows through the screen, the vapor bubbles are separated out and flow upwardly, under the influence of gravity, to the top of the inlet cavity where they can be withdrawn with the excess fuel.

During operation of the pump, it is important to minimize any forces which tend to cause undesired irregularities in the output of the pump. Since the fuel is supplied to the pump under pressure, if this fuel was merely directed into one side of the working chamber of the pump, the fuel would impinge against the rotating components of the pump. The resulting fluid thrust forces on the rotating components of the pump would press them against stationary pump components. This would increase the friction forces on the side of the rotating pump components opposite from the side against which the fuel is directed.

To prevent this from occurring, the fuel is supplied to opposite sides of the working chamber from an inlet passage. In addition, fuel flows to opposite sides of a pump rotor through passages formed in the rotor. Since both sides of the pump rotor and working chamber are supplied with the fuel at inlet pressure, the fluid pressure forces on opposite sides of the rotating components of the pump are equalized. A uniform pump output is further promoted by providing for the dampening of pressure pulses in the fuel discharged from the pump. This is accomplished by a seal which performs the dual functions of separating the inlet cavity from an outlet cavity and of flexing under the influence of fluid pulses in the outlet cavity to dampen these pulses.

In addition to the foregoing operating features, commercial factors dictate that the pump and motor assembly be readily and accurately assembled with a minimum of difficulty. To this end, the pump and motor assembly are advantageously enclosed within a casing formed by a tubular side wall having locating surfaces which position the pump relative to the motor. The various operating components of the pump are accurately positioned in a coaxial relationship with each other by mounting them on the motor armature shaft and an accurately machined sleeve on the armature shaft. Assembling operations are further facilitated by the use of a single spring element to perform the dual functions of pressing the seal which separates the inlet and outlet cavities into tight sealing engagement with an outer cheek plate of the pump and to press the outer cheek plate of the pump against a cam ring and inner cheek plate of the pump.

Accordingly, it is an object of this invention to provide a new and improved pump and motor assembly for use in regulating a flow of fuel to an engine and wherein all of the fluid connections to the pump are located at one end portion of the pump and motor assembly to facilitate locating of the assembly in cramped quarters adjacent to the engine and to reduce the possibility of fuel leakage from the assembly.

Another object of this invention is to provide a new and improved pump and motor assembly for use in regulating a flow of fuel to an engine and wherein a one-piece casing is utilized to enclose both the pump and the motor.

Another object of this invention is to provide a new and improved pump and motor assembly for use in regulating a flow of fuel to an engine and wherein any vapor entrained in the fuel is removed before the fuel enters the pump.

Another object of this invention is to provide a new and improved pump and motor assembly for use in regulating a flow of fuel to an engine and wherein inlet fluid forces on opposite sides of moving components of the pump are balanced to tend to promote a uniform output from the pump.

Another object of this invention is to provide a new and improved pump and motor assembly for use in regulating a flow of fuel to an engine and wherein the motor armature and an accurately formed sleeve member are utilized to accurately position various components of the pump in a coaxial relationship with each other.

Another object of this invention is to provide a new and improved pump and motor assembly for use in regulating a flow of fuel to an engine and wherein pressure pulses in the output of the pump are dampened to provide for a uniform rate of supply of fuel to the engine.

Another object of this invention is to provide a new and improved pump and motor assembly for use in regulating a flow of fuel to an engine and wherein the pump and motor can be readily interconnected and assembled with a minimum of difficulty and expense.

BRIEF DESCRIPTION OF THE DRAWINGS

The foregoing and other objects and features of the present invention will become more apparent upon a consideration of the following description taken in connection with the accompanying drawings wherein:

FIG. 5 is a plan view, taken on a reduced scale along the line 5—5 of FIG. 3, illustrating the relationship between an inner cheek plate of the pump and a screen for promoting the removal of air bubbles from the fuel;

FIG. 6 is a sectional view, taken generally along the lines 6—6, further illustrating the relationship between the cheek plate and screen;

DESCRIPTION OF SPECIFIC PREFERRED EMBODIMENTS OF THE INVENTION

Figure 1:
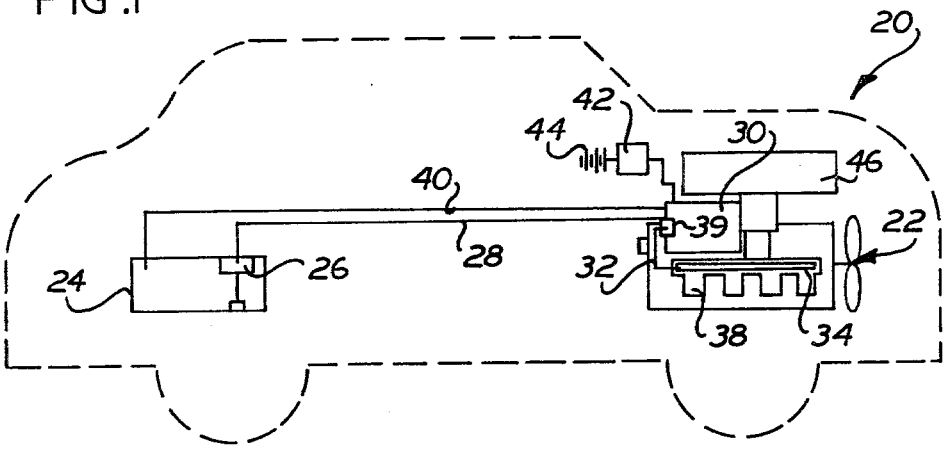
FIG. 1 is a schematic illustration of a vehicle having a pump and motor assembly constructed in accordance with the present invention to regulate a flow of fuel to an engine.

A vehicle 20 is illustrated schematically in FIG. 1 and has an internal combustion engine 22 which is supplied with fuel from a tank or source 24. A charge pump 26 is located in the tank 24 and supplies a continuous flow of fuel under pressure to an inlet conduit 28 connected with one end of a pump and motor assembly 30 constructed in accordance with the present invention. Fuel flow is conducted from the pump and motor assembly 30 through a conduit 32 to a fuel distribution arrangement 34 connected with the intake manifold 38 of the engine 22. A device 39 (FIG. 1) is provided to measure rate of flow of fuel from the pump. Excess fuel supplied to the pump and motor assembly 30 is returned to the tank 24 through a conduit 40.

During operation of the engine 22, suitable controls, indicated schematically at 42 in FIG. 1, monitor various engine operating conditions. The controls 42 regulate the rate at which the pump and motor assembly 30 is operated under the influence of electrical power. By monitoring the engine operating conditions, the rate of fuel flow as measured by the device 39, and the volume of air being taken into the manifold 38 through an air intake 46, it is possible for the controls 42 to effect an optimum air-fuel mixture in the intake manifold 38. Thus, if the controls 42 detect that for a given engine operating condition the air-fuel mixture is too rich, the speed of operation of the pump and motor assembly 30 is reduced to effect a reduction in the rate of flow of fuel to the distribution arrangement 34 and cylinder chambers of the engine 22. Similarly, if the controls 42 detect that the air-fuel mixture is too lean, the speed of operation of the pump and motor assembly is increased to effect an increase in the rate of flow of fuel to the engine. By controlling the rate of operation of the pump and motor assembly 30 it is possible to provide an accurately metered flow of fuel to the engine at a rate which optimizes engine performance over a wide range of operating conditions. Although many different types of controls 42 could be utilized, the controls 42 are constructed in the manner disclosed in U.S. Pat. No. 3,935,851.

Although the pump and motor assembly 30 has been disclosed herein in association with a fuel distribution system in which fuel is introduced into the intake manifold 38, it is contemplated that the pump and motor assembly 30 could be associated with other types of fuel distribution systems. For example, the pump and motor assembly 30 could be used with a fuel distribution system in which the fuel is injected directly into the engine cylinders or operating chambers rather than being conducted to the operating chambers through the intake manifold 38. It is also contemplated that the pump and motor assembly 30 could be utilized in association with known carburetors.

The pump and motor assembly 30 is utilized to regulate the flow of fuel from the tank 24 to provide an accurately metered flow of fuel to the cylinders or operating chambers of the engine 22. The pump and motor assembly 30 includes an electric motor 50 (see FIG. 2) which drives a pump 52. Operation of the pump 52 causes fuel to flow from an inlet passage 54 connected with the fuel tank 24, through the measuring device 39 to an outlet passage 56 connected with the engine intake manifold 38.

The rate at which fuel is supplied to the inlet passage 54 by the charge pump 26 (see FIG. 1) is greater than the rate at which fuel is discharged from the outlet passage 56 (FIG. 2) to the engine 22. The flow of excess fuel is returned to the tank 24 by way of a return passage 60 which is connected in fluid communication with the conduit 40. Since a substantially constant flow of fuel is supplied by the charge pump 26 at a rate which is substantially greater than the maximum rate at which fuel is supplied to the engine 22, there is a continuous flow of excess fuel back to tank at a rate which varies with variations in the rate at which fuel is burned by the engine 22.

All of the fluid connections for the pump 52 are formed in a relatively rigid cast metal end section 62 located at one axial end of a housing assembly 64. By providing all of the fluid connections for the pump 52 at one end of the housing assembly 64, the pump and motor assembly 30 can be located in relatively cramped quarters closely adjacent to the engine 22 in the manner illustrated schematically in FIG. 1. In addition, the placing of all of the fluid connections for the pump and motor assembly in the end section 62 facilitates the making of fluid tight connections with a minimum danger of leakage. Of course, it is important to avoid leakage of fuel in the engine compartment of a vehicle.

In addition to the metal end section 62, the housing assembly 64 includes a casing 68 which is stamped as one-piece from sheet metal. By forming the casing 68 as one-piece, the only seal formed between components in the housing assembly 64 is at the joint where the end section 64 extends across an open end of the casing 68. This single joint can be easily sealed by using a suitable end section seal ring 70 and by firmly bolting the end section 62 to the casing 68. Since all of the fluid connections are formed in the end section 62 and the casing 68 is free of fluid connections, there is no possibility of the leakage of fuel from the casing 68 at a fluid connection.

The casing 68 includes a circular end wall 72 which is integrally formed with a tubular side wall 74. The tubular side wall 74 cooperates with the end wall 72 to define a generally cylindrical chamber 76 in which the motor 50 and pump 52 are disposed in a coaxial relationship with each other and with the central axis of the tubular side wall. The electric motor 50 includes a stator 78 which is fixedly connected with a cylindrical inner surface of the tubular side wall 74. The stator 78 circumscribes a rotatable armature 80 having a central shaft 84 which is rotatably supported at one end by a bearing 86 mounted in a recess 88 formed in the end wall 72 of the casing 68.

A dividing wall 92 of a suitable polymeric material engages a cylindrical inner surface 94 of the tubular side wall 74 to divide the casing chamber 96 into a cylindrical motor chamber 98 and a cylindrical pump chamber 100. The wall 94 rotatably supports the armature shaft 84 and is provided with suitable recesses 104 in which motor brushes 106 are slidably mounted. The brushes 106 are spring pressed into engagement with a cummutator ring 108 on the armature. It should be noted that the wall 92 supports the armature shaft 84 with its central axis generally horizontal and coincident with the central axis of the tubular side wall 74. Therefore, upon energization of the motor 50 the armature 80 rotates about the central axis of the casing 68 to drive the pump 52 in a known manner. Suitable openings 110 (FIG. 3) are formed in the wall 94 to enable fuel to flow from the pump chamber 100 to the motor chamber 98 to thereby cool the motor 50. The motor 50 has been illustrated somewhat schematically in FIG. 2 and many different types of electric motors could be utilized if desired.

Figure 4:
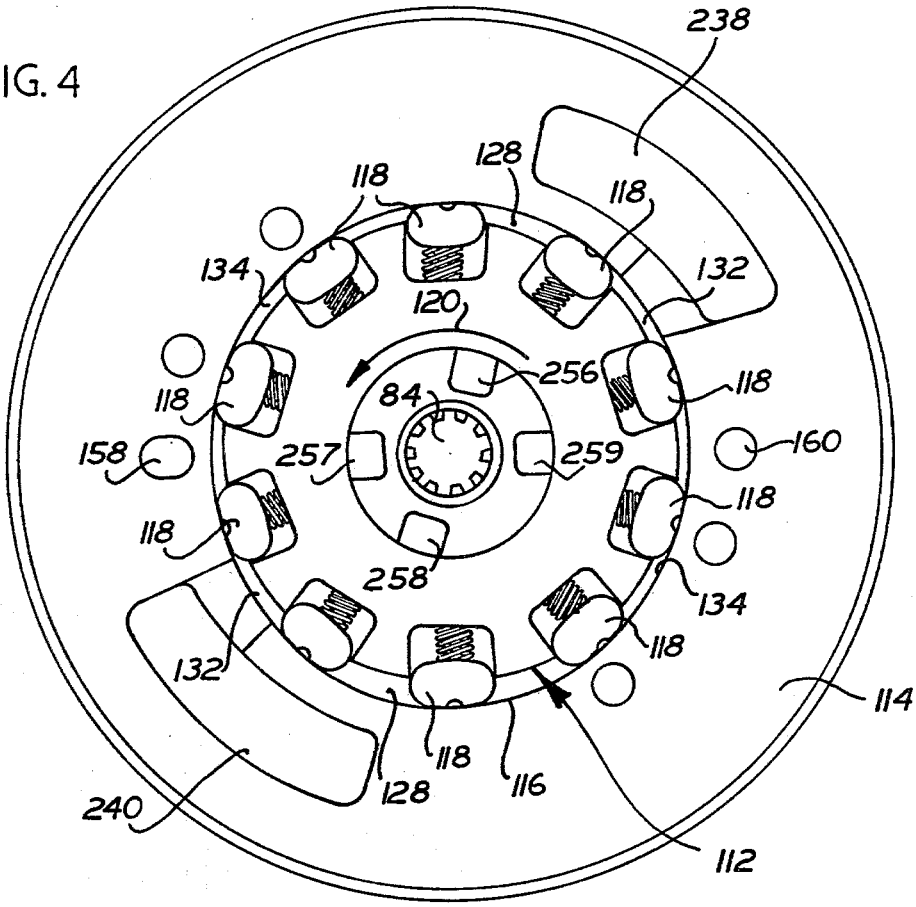
FIG. 4 (on sheet 1 of the drawings) is an enlarged sectional view, taken generally along the line 4—4 of FIG. 3, illustrating the relationship between a motor driven pump rotor and a cam ring.
Figure 2:
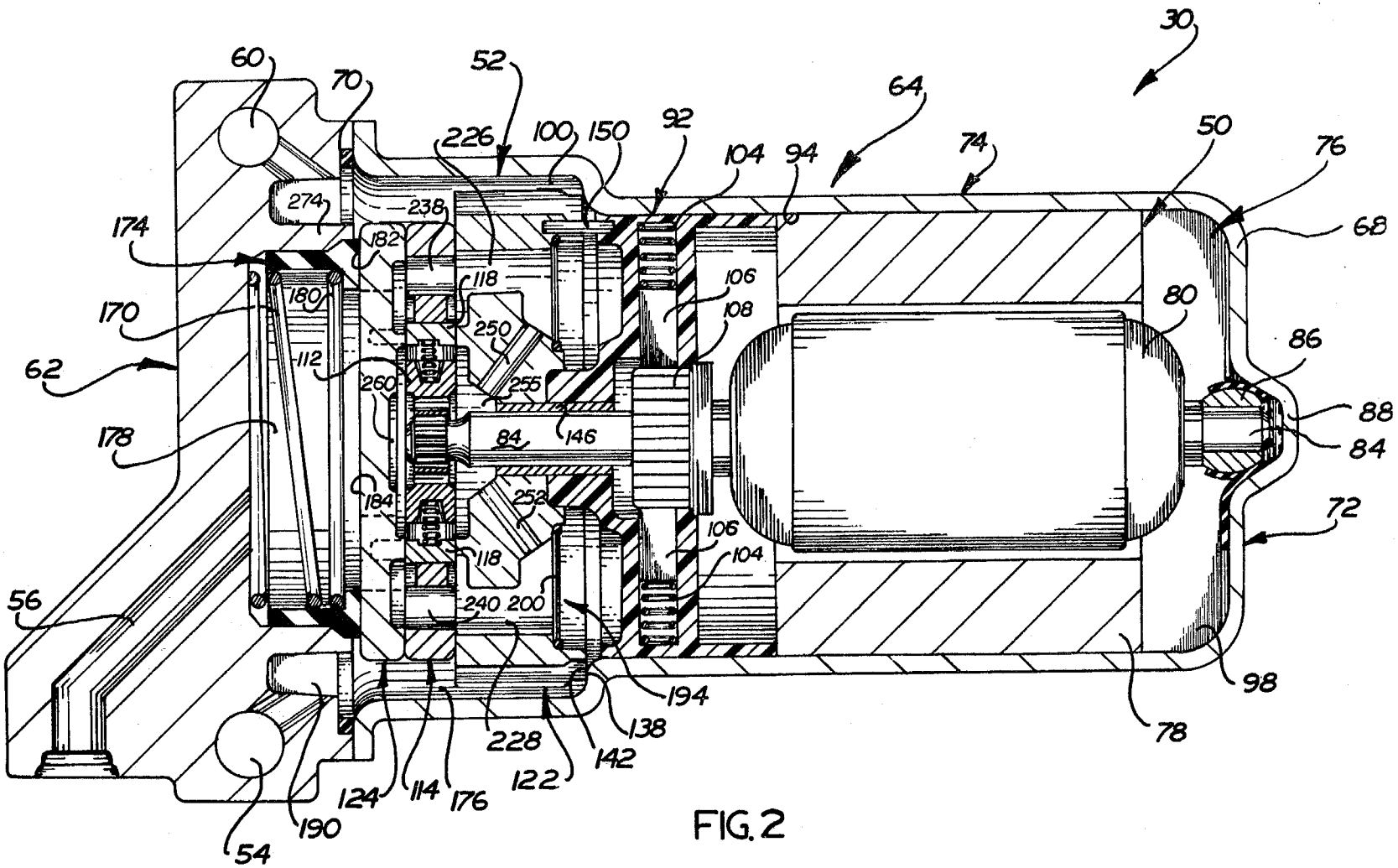
FIG. 2 is a sectional view of the pump and motor assembly utilized in the vehicle of FIG. 1.
Figure 3:
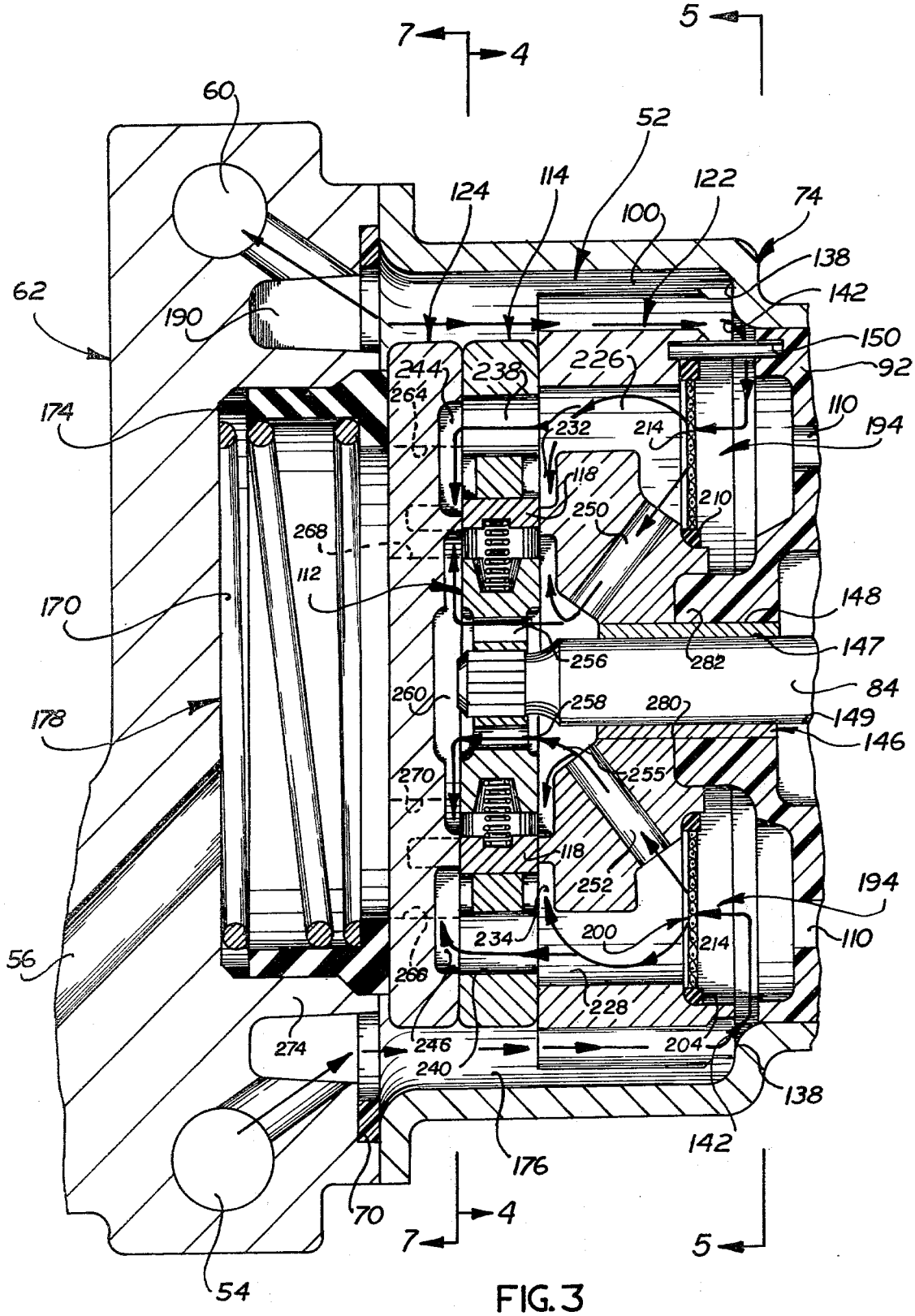
FIG. 3 is an enlarged sectional view of a portion of FIG. 2, further illustrating the construction of the pump.

The construction of the pump 52 is illustrated in FIGS. 2 and 3 and includes a rotor 112 which is mounted on an output end portion of the armature shaft 84 in a coaxial relationship with the motor 50. The rotor 112 is circumscribed by a cam ring 114 having an inner or cam surface 116 (see FIG. 4) which cooperates with slippers or pumping elements 118 (FIG. 4) mounted on the rotor 112. Upon energization of the motor 50, the rotor 112 rotates in the direction of the arrow 120 in FIG. 4. As the rotor 112 rotates the cam ring 114 and slippers 118 cooperate to pump fuel in a known manner.

An inner check plate 122 (FIG. 3) and an outer cheek plate 124 cooperate with the cam ring 114 and pumping elements 118 on the rotor 112 to form a pair of working or pumping chambers 128. Each of the working chambers 128 has an inlet area 132 at which fuel enters the working chamber and an outlet area 134 at which fuel is discharged from the working chamber. The configuration of the cam ring surface 116 and the manner in which the slippers 118 cooperate with the cam ring surface to pump fluid is the same as is disclosed in U.S. patent application Ser. No. 520,497, filed Nov. 4, 1974 by Gilbert H. Drutchas and George A. Berman and entitled "Optimum Porting Configuration For A slipper Seal Pump." Although the pumping elements 118 are slippers in the illustrated embodiment of the invention, it is contemplated that other types of pumping elements, such as rollers or vanes, could be utilized if desired.

In accordance with one of the features of the present invention, the same one-piece casing or enclosure 68 (see FIG. 2) is utilized as a housing for both the motor 50 and the pump 52. Thus, the tubular side wall 74 of the casing 68 is fixedly connected with the stator 78 of the motor 50 and forms the housing for the motor. Similarly, the one-piece tubular side wall 74 circumscribes the pump 52 and forms the housing for the pump. By utilizing the same one-piece casing member to form the enclosure for both the motor 50 and pump 52, the assembly in the housing 64 is facilitated.

To facilitate positioning of the pump 52 within the casing 68, the tubular side wall 74 is provided with a radially extending pump locating surfaces 138 (see FIG. 3). The annular locating surface 138 engages the circular inner cheek plate 122 to locate the pump 52 axially in the casing chamber 76. Thus, in order to locate the pump 52 axially in the casing chamber 76, axially inner locating surfaces 142 (FIGS. 5 and 6) on the inner cheek plate 122 abut the accurately formed locating surface 138 (FIG. 3) on the casing 68.

The pump 52 is radially centered within the cylindrical casing chamber 76 by mounting the inner cheek plate 122 coaxial with the output end portion of the armature shaft 84. It is contemplated that for reasons of ease of manufacture, the annular locating surface 138 could be replaced by three circumferentially spaced apart and radially extending locating surfaces which would project from an annular shoulder in the tubular side wall 74. The inner cheek plate 122 is disposed on an accurately formed cylindrical sleeve bearing 146 on the armature shaft 84. The cylindrical configuration of the sleeve bearing 146 enables it to be readily formed with accurately dimensioned cylindrical and exactly coaxial inner and outer surfaces 147 and 148. The cylindrical inner surface 147 circumscribes and is disposed in engagement with a cylindrical outer surface 149 of the armature shaft 84. The cylindrical sleeve bearing 146 is held against rotation by the wall 92 and supports the inner cheek plate 122 in an exactly coaxial relationship with the rotor 112. The inner cheek plate 122 is fixedly held against rotation relative to the wall 92 by an anchor pin 150.

Figure 7:
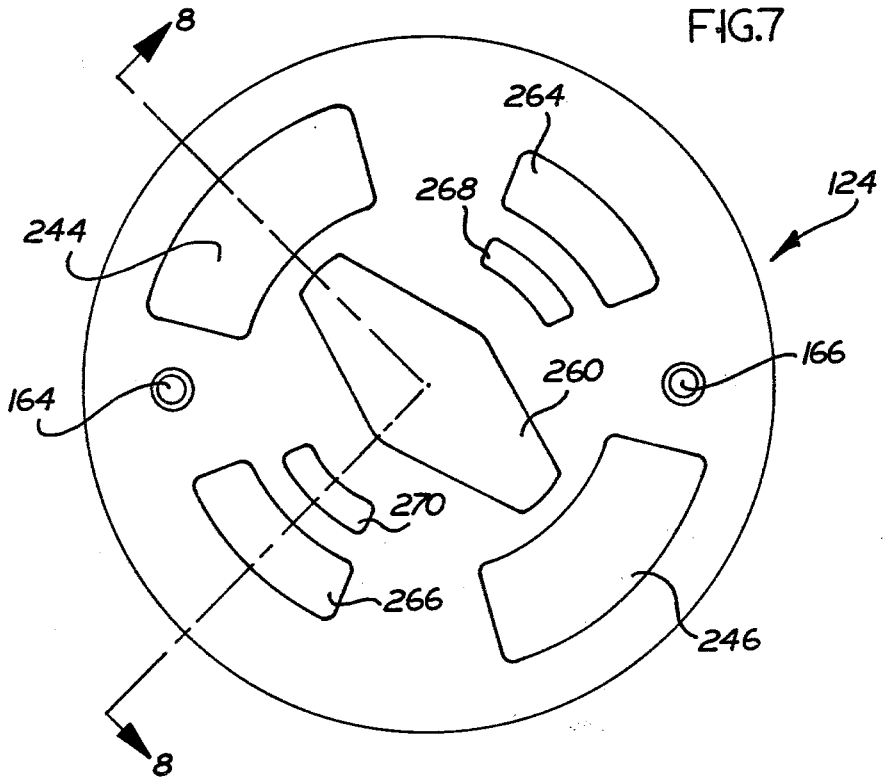
FIG. 7 is a plan view, taken on a reduced scale along the line 7—7 of FIG. 3, illustrating the construction of an outer cheek plate of the pump.

The inner cheek plate 122 is provided with a pair of dowel pins 154 and 156 (see FIG. 6) which extend through holes 158 and 160 (see FIG. 4) formed in the cam ring 114 to accurately position the cam ring relative to both the cheek plate 122 and rotor 112. The dowel pins 154 and 156 extend through the cam ring 114 into engagement with blind holes 164 and 166 (see FIG. 7) formed in the outer cheek plate 124 to accurately position the outer cheek plate relative to both the cam ring 114 and the inner cheek plate 122. Thus, by mounting the inner cheek plate 122 on the armature shaft 84 in a coaxial relationship with the rotor 112, the cam ring 114 and outer cheek plate 124 are also located in a coaxial relationship with the rotor 112 to provide for an accurate positioning of the various parts of the pump 52 relative to each other and to the casing 68.

The assembly of the pump 52 is facilitated by the fact that the cam ring 114 and outer cheek plate 124 are slidably disposed on the dowel pins 154 and 156 which are fixedly mounted on the inner cheek plate 122. This enables the various parts of the pump to merely be stacked up within the casing 68 around the motor armature shaft 84.

To hold the cam ring 114 and outer cheek plate 124 against axial movement relative to each other and to the inner cheek plate 122, a coil spring 170 (see FIGS. 2 and 3) is disposed in a coaxial relationship with the armature shaft 84 and presses the outer cheek plate 124 axially in tight sealing engagement with the cam ring 114. The cam ring 114 is in turn pressed in tight sealing engagement with the inner cheek plate 122. The spring 170 is of sufficient strength to prevent the outer cheek plate 124 from moving axially away from the cam ring 114 under the influence of fluid pressure forces during operation of the pump 52. This results in the pump being of the positive displacement type. Therefore, by controlling the speed of operation of the motor 50, the rate of fuel flow to the engine 22 can be controlled.

In addition to pressing the outer cheek plate 124 and can ring 114 to tight sealing engagement with each other and with the inner cheek plate 122, the coil spring 170 presses a generally cylindrical seal 174 (FIGS. 2 and 3) into tight sealing engagement with the outer cheek plate 124 to block fluid flow between an inlet cavity 176 and an outlet cavity 178. The spring engages an annular lip 180 (FIG. 3) formed on the seal 174 to press a circular axially inner end surface 182 of the seal into tight sealing engagement with a flat circular outer surface 184 of the outer cheek plate 124. Thus, the spring 170 performs dual functions of pressing the components of the pump 52 into tight sealing engagement with each other and pressing the seal 174 into tight sealing engagement with the outer cheek plate 124 to prevent the leakage of fluid between the inlet cavity 176 and the outlet cavity 178.

During operation of the engine 22, the motor 50 is energized to rotate the armature shaft 84 and drive the pump 52. At this time the charge pump 26 (FIG. 1) supplies a continuous flow of fuel under an initial pressure through a conduit 28 to the inlet passage 54 (see FIG. 3) formed in the end section 62 of the housing assembly 64. The inlet passage 54 is connected in fluid communication with the generally annular inlet cavity 176 which circumscribes the outside of the pump 52. The inlet cavity 176 includes an annular section 190 formed in the end section 62. The inlet passage 54 is connected with the bottom or lower portion of the annular section 190 of the inlet cavity 176 while the upper portion of the annular section 190 is connected with the excess fluid return passage 60.

Fuel from the inlet passage 54 flows into the inlet cavity 176 and flows around the outside of the pump 52 and axially toward the right (as viewed in FIGS. 2 and 3) to a pump inlet area 194 at the right end of the pump 52. Thus, fluid from the inlet passage 54 must flow the axial length of the inlet cavity 176 to the pump inlet 194. Since the inlet cavity 176 has a relatively large annular cross sectional area, compared to the cross sectional area of the inlet passage 54, the fuel will flow at a rather low speed from the inlet passage 54 to the inlet 194 for the pump. This provides time for vapor bubbles entrained in the fuel to gravitate upwardly from the bottom of the inlet cavity 176 to the top of the inlet cavity.

Due to the effect of gravitation, the vapor bubbles tend to accumulate at the top of the inlet cavity 176 where they are withdrawn from the cavity by the continuous flow of excess fuel into the return passage 60. The return passage 60 is connected in fluid communication with the tank 24 by the conduit 40 so that the vapor bubbles do not pass through the pump 52 but are merely returned to the tank. This is important since if the vapor bubbles were allowed to pass through the pump 52 they would be discharged to the fuel flow rate measuring device 39 (FIG. 1). If vapor is mixed with the fuel which is conducted through the measuring device 39, the measured quantity of fuel will not be discharged to the engine 22. Of course, this would effect the air-fuel mixture supplied to the engine 22.

In addition to providing for the relatively slow movement of the fuel through the inlet cavity 176 to provide time for the vapor entrained in the fuel to gravitate upwardly to the return passage 60, a screen 200 is provided at the pump inlet area 194 (see FIGS. 3, 5 and 6). The screen 200 includes a frame 204 (FIGS. 5 and 6) which is mounted on the inner cheek plate 122. The frame 204 has an annular outer section 206 which sealingly engages the inner cheek plate 122 and circumscribes the outside of the entrance area 94. A plurality of radially extending legs 208 (FIG. 5) extend inwardly to an annular inner section 210 which sealingly engages the central portion of the cheek plate 122. A fine mesh screen 214 is supported by the frame 204.

Fuel entering the pump 52 must flow through the screen 214 in the manner indicated schematically by the arrows in FIG. 3. As the fuel passes through the screen 214, vapor bubbles are caught on the outside of the vertical screen. These vapor bubbles more upwardly under the influence of gravitational forces and do not pass through the screen. Thus, the entry of vapor into the pump 52 and fuel flow rate measuring device 39 is prevented by providing a relatively large inlet cavity 176 through which the fuel flows at a relatively slow rate so that vapor bubbles can gravitate upwardly to the fluid return passage 60 and by the use of the screen 214 in the entrance area 194 to the pump 52.

The separation of vapor bubbles from the fuel is further promoted by causing the fuel to flow around a relatively sharp corner between the locating surface 138 formed in the tubular side wall 74 and the axially inner end portion of the cheek plate 122. Thus, the fuel which flows from the inlet passage 54 at the left end of the pump must move along a path which extends axially along the outside of the entire axial length of the pump and then must flow through one of a pair of slots 222 and 224 (see FIG. 5) in order to pass between the axially inner end of the cheek plate 122 and the locating surface 138 on the casing side wall 74. As the fuel flows radially inwardly around this corner, the relatively light vapor bubbles tend to move outwardly and upwardly in the inlet cavity to further promote the separation of the vapor bubbles from the fuel. It should be noted that as this is happening, the upward flow of the relatively light vapor bubbles is promoted by the fact that fuel is continuously being returned to the tank through the return passage 60 and conduit 40.

After the fuel has passed through the screen 214, it enters a pair of inlet passages 226 and 228 (see FIG. 3) formed in the inner cheek plate 122. The inlet passages 226 and 228 are provided with radially extending recesses 232 and 234 disposed between an axially inner side of the cam ring 114 and the cheek plate 122 so that fuel can flow into the inlet areas 132 of the working chambers 128. It should be noted that in flowing from the inlet area 190 to the pump 52 to the working chambers 128, the fuel moves along a flow path which turns several times to thereby prevent the fuel from impinging directly against the rotor 112 and slippers 118.

Since the inlet fluid is supplied under pressure by the tank mounted charge pump 26 (see FIG. 1), if the fuel was allowed to enter the working chambers 128 on only one side of the rotor 112, for example the inner side at the recesses 232 and 234, the rotor and slippers 118 would be subjected to axial thrust forces. These thrust forces would press the slippers 118 and rotor 112 toward the stationary cheek plate 124 in a manner which would tend to increase friction and retard uniform rotation of the rotor. Since optimum operation of the engine 22 requires a uniform flow of fuel from the pump 52, it is desirable to eliminate any forces which may tend to retard uniform rotation of the rotor 112. Accordingly, arcuate passages 238 and 240 (see FIGS. 3 and 4) are formed in the cam ring 114 to connect the inlet passages 226 and 228 in the inner cheek plate 122 with opposite sides of the cam ring. Inlet fluid flows through the cam ring passages 238 and 240 into recesses 244 and 246 (FIGS. 3 and 7) formed in the outer cheek plate 124. The inlet fluid flows from the outer cheek plate recesses 244 and 246 into the working chambers 128 in a direction opposite from the direction from which the fluid enters the working chambers from the recesses 232 and 234 in the inner cheek plate 122 to thereby equalize the forces applied to the rotor 112 and the slippers 118 and promote uniform rotation of the rotor 112.

The under sides of the slippers 118, that is the radially inner sides of the slippers 118, are also supplied with fluid from the inlet areas 226 and 228 in the inner cheek plate 122. Thus, the inlet fluid flows through cylindrical passages 250 and 252 (see FIG. 3) formed in the inner cheek plate 122 to a central recess 255 which is connected in fluid communication with the radially inner side of the slippers 118. In order to provide for equal axial forces on both sides of the rotor 112, four passages 256, 257, 258 and 259 (FIG. 4) extend axially through the rotor to a central recess 260 (FIGS. 3 and 7) formed in the outer cheek plate 124. The recess 260 (FIG. 3) is connected in fluid communication with the under side of the slippers 118 at a location opposite from the location at which the recess 255 is connected with the under side of the slippers 118. Thus, by providing for a flow of the inlet fluid through the axially extending rotor passages 256–259, the sideward forces to which the rotor 112 is subjected by the inlet fluid are equalized to promote the uniform rotation of the rotor.

Figure 8:
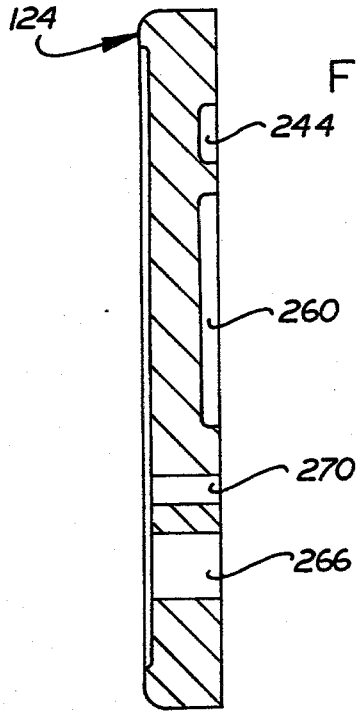
FIG. 8 is a sectional view, taken generally along the line 8—8 of FIG. 7, further illustrating the construction of the outer cheek plate.

As the rotor 112 rotates relative to the cam ring 114, the slippers are moved radially inwardly and the fuel is discharged under pressure in a known manner at outlet areas 134 of the working chambers 128. Thus, the relatively high pressure flow of fluid passes through a main set of outlet ports 264 and 266 (see FIGS. 3, 7 and 8) formed in the outer cheek plate 124. Fluid is discharged from beneath the slippers 118 through relatively small outlet openings 268 and 270 (FIGS. 7 and 8) formed in the outer cheek plate 124 at a location radially inwardly of the main outlet openings 264 and 266.

The fluid discharged from the working chambers of the pump 52 through the openings in the outer cheek plate 122 enters a cylindrical outlet cavity 178. The outlet cavity 178 is disposed in a coaxial relationship with the inlet cavity 176 and is separated from the inlet cavity by an annular wall 274 formed in the end section 62 (see FIG. 2) and by the seal 174. It should be noted that the annular configuration of the inlet cavity 176 and the circular configuration of the outlet cavity 178 allows them to be disposed in a coaxial relationship in the end section 62. This enables fuel inlet and return connections to the inlet cavity 176 and a fuel discharge connection to the outlet cavity 178 to be located at the same end of the housing assembly 64.

Fuel discharged from the pump 52 to the outlet cavity 178 flows through the outlet passage 56 to the flow rate measuring device 39 and then to a suitable fuel distribution arrangement connected in fluid communication with the cylinders of the engine 22. It should be noted that the fluid pressure in the outlet cavity 178 supplements the force provided by the spring 170 and tends to urge the outer cheek plate 124 into tight sealing engagement with the cam ring 114 and to in turn urge the cam ring 114 into tight sealing engagement with the inner cheek plate 122.

During operation of the motor 50 and pump 52, it is contemplated that undesirable pressure pulses and fuel flow surges may occur in the fuel discharged from the pump 52 to the outlet cavity 178. In order to dampen these fluid pressure pulses and flow surges to minimize their effect on the operation of the engine 22, the resilient seal 174 deflects under the influence of the fluid pressure pulses and fuel flow surge. As the resilient seal 174 deflects, the size of the outlet cavity 178 increases slightly to thereby at least partially absorb a fluid pressure pulse. Thus, upon the occurrence of a fluid pressure pulse, the seal 78 is forced radially outwardly into the space between the annular end surface of the wall 274 and the outer cheek plate 124. This radially outward deflection of the seal 174 occurs because the outer side surface of the seal is exposed to the relatively low fluid pressure in the inlet cavity 176 while the inner side surface of the seal is exposed to the relatively high fluid pressure in the outlet cavity 178. It should be noted that the seal 174 is formed of a resiliently deflectable material, which to some extent at least, is compressed by the fluid pressure pulses to further provide for the dampening of the fluid pressure pulses.

During operation of the pump 52, a torque load is transmitted from the rotor 112 to the cam ring 114. This torque load results from the fact that the slippers 118 slide along the inside surface of the cam ring 114 and the cam ring tends to rotate with the slippers. Of course, if the pump 52 is to function properly, the cam ring 114 must be held against rotational movement relative to the housing assembly 64. To this end, the rotational forces transmitted to the cam ring 114 are transmitted to the fixedly mounted housing assembly 64 to hold the cam ring against rotation. Thus, upon rotation of the rotor 112 and the application of rotational load forces to the cam ring 114, the rotational load forces are resisted by the dowel pins 154 and 156 (see FIG. 6) which extend through the openings 158 and 160 (FIG. 4) in the cam ring 114. The rotational load forces are transmitted from the dowel pins to the inner cheek plate 122. The inner cheek plate 122 is held against rotation by the pin 150 which extends between the cheek plate with the stationary wall 92. The stationary wall 92 is in turn fixedly connected with the tubular side wall 74 of the housing assembly 64. Therefore, rotational movement of the cam ring 114 is resisted by the tubular side wall 74 and only the pump rotor 112 and motor armature 80 rotate upon energization of the electrical motor 50.

Figure 9:
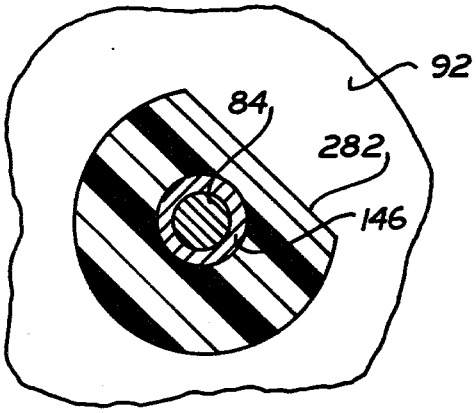
FIG. 9 is a sectional view illustrating a mounting section utilized to hold the inner cheek plate and cam ring against rotational movement.

In order to further hold the inner cheek plate 122 against rotation under the influence of torque loads applied to the cheek plate during operation of the pump 52, the cheek plate is provided with a recess 280 (FIG. 3) in its inner end face. The recess 280 has a noncircular cross sectional configuration corresponding to the cross sectional configuration of a projection 282 (see FIG. 9) formed on the wall 92. The projection 282 on the wall 92 cooperates with the recess 280 in the inner cheek plate 122 to further hold the cheek plate against rotation. However, it should be understood that if desired, the projection 282 could be omitted and the cheek plate held against rotation by suitable connections such as the pin 150 or in other ways. It is also contemplated that the cheek plate 122 could be held against rotation by a projection from the surface of the tubular side wall of the casing.

Figure 10:
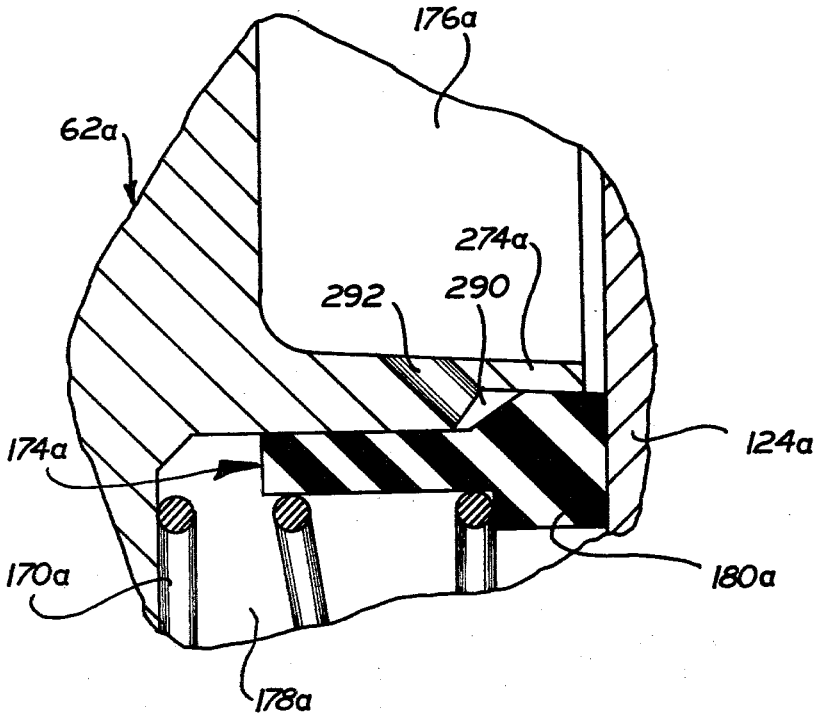
FIG. 10 is a fragmentary view of a second embodiment of the invention in which a pressure chamber is provided to dampen pressure pulses in the fuel discharged from the pump.

In the embodiment of the invention illustrated in FIGS. 1–9, the seal 174 is resiliently deformed to absorb fluid pressure pulses and fuel flow surges transmitted to the outlet cavity 178. It is contemplated that under certain circumstances it is desirable to provide for further dampening of fluid pressure pulses from the pump 52. Accordingly, it is contemplated that a pressure chamber could be provided in association with the seal 174 and that fluid could be discharged from the pressure chamber to the inlet chamber in order to provide for resilient deflection of the seal. The manner in which such a seal would cooperate with the end section of the pump assembly is illustrated in FIG. 10. Since the embodiment of the invention illustrated in FIG. 10 is generally the same as the embodiment of FIG. 1-9, similar numerals will be utilized to designate the similar parts, the suffix letter "a" being associated with the numerals utilized to designate the components of FIG. 10 to avoid confusion.

In the embodiment of the invention illustrated in FIG. 10, a seal **174*a* cooperates with an annular walll 274*a* formed on an end section 62*a* to provide a pressure chamber 290. The annular pressure chamber 290 is connected in fluid communication with an inlet cavity 176*a* by a passage 292. The seal 174*a* is pressed into tight sealing engagement with an inner cheek plate 124*a* by a coil spring 170*a***.

Upon the occurrence of a pressure pulse or fuel flow surge in the outlet cavity **178*a*, the seal 174*a* is resiliently deflected outwardly to decrease the size of the pressure chamber 290. This results in fluid being expelled from the pressure chamber 290 through the passage 292 to the inlet chamber 176*a*. The rate at which fluid is discharged to the inlet chamber 176*a* from the pressure chamber 290 controls the rate at which the pressure pulse is dampened. Thus, by properly sizing the passage 292**, the rate at which the pressure pulses are dampened can be controlled to provide desired dampening characteristics.

In view of the foregoing description, it can be seen that the present invention provides a new and improved pump and motor assembly 30 which is utilized to regulate the flow of fuel to an internal combustion engine 22. The pump and motor assembly 30 is relatively compact and has fluid connections with the supply conduit 28, return conduit 40 and high pressure discharge conduit 32 in the end section 62. This facilitates mounting of the pump and motor assembly 30 in cramped quarters adjacent to an engine. The possibility of fuel leakage is also reduced by having all of the fluid connections in the end section 62 and providing a single seal at the joint between the one-piece casing 68 and the end section 62. It should be noted that the motor chamber 98 is provided with a single opening through which electrical leads extend to provide for energization of the motor 50.

During operation of the pump 52, a flow of fuel in which vapor bubbles may be entrained enters the inlet cavity 176 disposed between the tubular side wall 74 and the outside of the pump 52. The vapor bubbles tend to gravitate toward the upper portion of the inlet cavity 176 where they are removed with excess fuel through the passage 60. The excess fuel and the vapor bubbles are returned to tank through the conduit 40. The flow of the vapor bubbles to the upper portion of the inlet cavity 176 is promoted by the fact that the inlet cavity has a horizontal central axis and a relatively long axial extent between the area where the fuel enters the cavity and the area where the fuel enters the pump 52. To further promote the separating of the vapor bubbles from the fuel, the screen 200 is provided at the inlet to the pump.

During operation of the pump 52, forces which tend to cause undesired irregularities in the output of the pump are minimized. This is accomplished by supplying fuel to both sides of the rotor 112. Thus, the radially outer end portions of the slipper pockets are supplied with fluid through passages 238 and 240 extending through the cam ring 114. In addition, passages 256–259 through the rotor 112 enable fluid to flow to the insides of the slipper pockets to thereby tend to equalize the effect of the inlet fluid on the rotor.

A uniform fluid flow from the pump 52 is further promoted by providing for the dampening of flow surges and pressure pulses in the fuel discharged from the pump 52. This is accomplished by the seal 174 which performs the dual functions of separating the inlet cavity 176 from the outlet cavity 178 and flexing under the influence of the fluid pressure pulses in the outlet cavity to dampen these pulses.

In order to facilitate assembly, the pump 52 and motor 50 are advantageously enclosed within a one-piece casing 68 formed by a tubular side wall 74 having a locating surface 138 which positions the pump 52 relative to the motor 50. The various operating components of the pump 52 are accurately positioned in a coaxial relationship with each other by mounting them on the armature output shaft 84 and the accurately machined tubular sleeve member 146. Thus, the rotor 112 is fixedly connected with the outer end portion of the shaft 84 for rotation therewith while the inner cheek plate 122 is mounted on the sleeve member 146 and held against rotation. The assembly of the pump is further facilitated by utilizing a single spring 170 to perform the dual functions of pressing the various components of the pump 52 into tight sealing engagement with each other and pressing the seal 174 into engagement with the pump 52 to separate the inlet and outlet cavities 176 and 178 from each other.

Having described specific preferred embodiments of the invention, the following is claimed:

1. A pump and motor assemby for use in regulating a flow of metal from a source of fuel to an operating chamber of an engine of a vehicle, said pump and motor assembly comprising a casing having an opening at one end, electric motor means disposed within said casing for providing an output force upon transmittal of electrical power to said electric motor means, said electric motor means including a stator fixedly connected with said casing and a rotatable armature circumscribed by said stator and having an output end portion, pump means disposed within said chamber in a coaxial relationship with said motor means for pumping fuel, said pump means including a cam ring, a rotor disposed within said cam ring and connected with said output end portion of said armature for rotation therewith, a plurality of pumping elements connected with said rotor for rotation therewith, said pumping elements and cam ring cooperating to partially define a working chamber having an inlet area and an outlet area, said pump means further including an inner cheek plate disposed between said rotor and said electric motor means, said inner cheek plate cooperating with said rotor and cam ring to further define said working chamber, and an outer cheek plate disposed on a side of said rotor and cam ring opposite from said inner cheek plate, said outer cheek plate cooperating with said rotor and cam ring to still further define said working chamber, said pump and motor assembly further including an end section fixedly connected across the open end of said casing, inlet passage means formed in said end section for receiving fuel from the source of fuel, said end section at least partially defining an inlet cavity connected in fluid communication with said inlet area of said working chamber and said inlet passage means to receive fuel from said inlet passage means, outlet passage means formed in said end section for receiving fuel discharged from said working chamber, said outlet passage means being connected in fluid communication with the engine operating chamber to enable fuel discharged from said working chamber of said pump means to be conducted to said engine operating chamber, said end section at least partially defining an outlet cavity connected in fluid communication with said outlet area of said working chamber and said outlet passage means to receive fuel discharged from said working chamber, and seal and pressure pulse dampening means disposed between said end section and pump means for preventing fluid flow between said inlet and outlet cavities and for at least partially dampening pressure pulses in fuel discharged from said working chamber, said seal and pressure pulse dampening means including a resilient member disposed in sealing engagement with said end section and said outer cheek plate to block fluid communication between said inlet and outlet cavities, said resilient member being resiliently flexible in a direction toward said inlet cavity under the influence of fluid pressure pulses in said outlet cavity to at least partially dampen the fluid pressure pulses, and spring means disposed between said resilient member and said end section for pressing said resilient member into tight sealing engagement with said outer cheek plate.

2. A pump and motor assembly as set forth in claim 1 wherein said resilient member is exposed on one side surface to the fluid pressure in said outlet cavity and is exposed on an opposite side surface to the fluid pressure in said inlet cavity.

3. A pump and motor assembly as set forth in claim 2 wherein at least a portion of the area on said opposite side surface of said resilient member which is exposed to the fluid pressure in said inlet cavity is disposed between said end section and said inner cheek plate.

4. A pump and motor assembly as set forth in claim 2 wherein said end section includes a wall disposed between a portion of said inlet cavity and a portion of said outlet cavity, said wall including surface means defining a passage extending through said wall and having a first open end portion exposed to fluid in said inlet cavity and a second open end portion exposed to said opposite side surface of said resilient member, said opposite side surface of said resilient member cooperating with said wall to at least partially define a pressure chamber connected in fluid communication with said inlet cavity by said passage in said wall, said resilient member being deflectable under the influence of pressure pulses in said outlet cavity to expel fluid from said pressure chamber to said inlet cavity to thereby at least partially dampen the pressure pulses.

5. A pump and motor assembly for use in regulating a flow of fuel from a source of fuel to an operating chamber of an engine of a vehicle, said pump and motor assembly comprising a casing forming a chamber with an opening at one end, said casing including an end wall and a tubular side wall connected with said end wall and having an open end portion opposite from said end wall, said tubular side wall being of a one-piece construction and having a length which is at least substantially as great as the length of said chamber, electric motor means disposed within said chamber for providing an output force upon transmittal of electric power to said electric motor means, said electric motor means including a stator fixedly connected with said casing and a rotatable armature circumscribed by said stator, said armature having an output end portion and a second end portion rotatably supported adjacent to said end wall of said casing with the axis of rotation of said armature coincident with a central axis of said tubular side wall of said casing, pump means disposed within said chamber in a coaxial relationship with said motor means for pumping fuel, said pump means including a cam ring, a rotor disposed within said cam ring and connected with said output end portion of said armature for rotation therewith about the central axis of said tubular side wall of said casing, a plurality of pumping elements connected with said rotor for rotation therewith, said pumping elements and cam ring cooperating to partially define a working chamber having an inlet area and an outlet area, said pump means further including an inner cheek plate disposed between said rotor and said electric motor means, said inner cheek plate cooperating with said rotor and cam ring to further define said working chamber, and an outer cheek plate disposed on a side of said rotor and cam ring opposite from said inner cheek plate, said outer cheek plate cooperating with said rotor and cam ring to still further define said working chamber, said pump and motor assembly further including an end section fixedly connected across the open end of said tubular side wall of said casing, inlet passage means formed in said end section for receiving fuel from the source of fuel at a first rate which under at least some vehicle operating conditions exceeds the rate at which fuel is discharged from said working chamber, said end section at least partially defining an inlet cavity connected in fluid communication with said inlet area of said working chamber and said inlet passage means to enable said inlet cavity to receive fuel from said inlet passage means at said first rate, return passage means formed in said end section for receiving fuel from said inlet cavity at a second rate which is equal to the difference between said first rate and the rate at which the fuel is discharged from said working chamber, said return passage means being connected in fluid communication with the source of fuel, and outlet passage means formed in said end section for receiving fuel discharged from said working chamber, said outlet passage means being connected in fluid communication with the engine operating chamber to enable fuel discharged from said working chamber of said pump means to be conducted to said engine operating chamber, said return passage means being connected in fluid communication with said inlet cavity at an upper portion of said inlet cavity, said inlet passage means being connected in fluid communication with said inlet cavity at a lower portion of said inlet cavity to enable vapor bubbles entrained in fuel introduced into said inlet cavity through said inlet passage means to rise upwardly in said inlet cavity and to subsequently leave said inlet cavity with fuel flowing from said inlet cavity into said return passage means.

6. A pump and motor assembly as set forth in claim 5 wherein said inlet cavity has an axial extent which is at least as great as the axial extent of said pump means and has a first axial end portion disposed adjacent to said end section and a second axial end portion adjacent to said inner cheek plate, said inlet passage means having an end portion which opens into said first axial end portion of said inlet cavity, said inner cheek plate including surface means for at least partially defining a passage having one end portion connected in fluid communication with said inlet area of said working chamber and a second end portion which opens into said second axial end portion of said inlet cavity whereby fuel flows from said first axial end portion of said inlet cavity to said second axial end portion of said inlet cavity before entering said pump means to enable vapor bubbles to rise upwardly toward the fuel flowing from said inlet cavity into said return passage means.

7. A pump and motor assembly as set forth in claim 6 further including screen means mounted on said inner cheek plate and extending across said second end portion of the passage which is at least partially defined by said inner cheek plate for blocking a flow of vapor bubbles from said inlet cavity into the passage which is at least partially defined by said inner cheek plate.

8. A pump and motor assembly as set forth in claim 7 wherein said inlet cavity circumscribes said pump means throughout the axial extent of said pump means.

9. A pump and motor assembly as set forth in claim 6 wherein said tubular sidewall includes first and second sections interconnected by a transverse wall section, said inner cheek plate being disposed in abutting engagement with said transverse wall section, said first section of said tubular sidewall at least partially defining a first portion of said chamber and having a first cross sectional area in a plane extending perpendicular to a longitudinal central axis of said tubular sidewall, said second section of said tubular sidewall at least partially defining a second portion of said chamber and having a second cross sectional area in a plane extending perpendicular to the longitudinal central axis of said tubular sidewall, said second cross sectional area being greater than said first cross sectional area, said second section of said tubular sidewall extending around and being spaced from said pump means, said inlet cavity being at least partially disposed in the space between said pump means and said second section of said tubular sidewall.

10. A pump and motor assembly for use in regulating a flow of fuel from a source of fuel to an operating chamber of an engine of a vehicle, said pump and motor assembly comprising a casing forming a chamber with an opening at one end, said casing including an end wall and a tubular side wall connected with said end wall and having an open end portion opposite from said end wall, said tubular side wall being of a one-piece construction and having a length which is at least substantially as great as the length of said chamber, electric motor means disposed within said chamber for providing an output force upon transmittal of electric power to said electric motor means, said electric motor means including a stator fixedly connected with said casing and a rotatable armature circumscribed by said stator, said armature having an end portion and a second end portion rotatably supported adjacent to said end wall of said casing with the axis of rotation of said armature coincident with a central axis of said tubular side wall of said casing, pump means disposed within said chamber in a coaxial relationship with said motor means for pumping fuel, said pump means including a cam ring, a rotor disposed within said cam ring and connected with said output end portion of said armature for rotation therewith about the central axis of said tubular side wall of said casing, a plurality of pumping elements connected with said rotor for rotation therewith, said pumping elements and cam ring cooperating to partially define a working chamber having an inlet area and an outlet area, said pump means further including an inner cheek plate disposed between said rotor and said electric motor means, said inner cheek plate cooperating with said rotor and cam ring to further define said working chamber, and an outer cheek plate disposed on a side of said rotor and cam ring opposite from said inner cheek plate, said outer cheek plate cooperating with said rotor and cam ring to still further define said working chamber, said inner cheek plate having surface means at least partially defining a passage extending axially through said inner cheek plate at a location spaced from a minor side surface of said inner cheek plate, said passage having openings in a first major side surface of the inner cheek plate at a location adjacent to said cam ring and in a second major side surface disposed opposite from said first major side surface, said pump and motor assembly further including an end section fixedly connected across the open end of said tubular side wall of said casing, inlet passage means formed in said end section for receiving fuel from the source of fuel at a first rate which under at least some vehicle operating conditions exceeds the rate at which fuel is discharged from said working chamber, said end section at least partially defining an inlet cavity connected in fluid communication with said inlet area of said working chamber and said inlet passage means to enable said inlet cavity to receive fuel from said inlet passage means at said first rate, said inlet cavity being connected in fluid communication with said inlet passage means at a location adjacent to said outer cheek plate and being connected in fluid communication with said inlet area of said working chamber by a fluid flow path which enters the passage in said inner cheek plate at the opening in said second major side surface of said inner cheek plate so that fuel enters said inlet cavity at one axial end of said pump means and flows from said one end of said pump means to the opposite axial end of said pump means before entering the passage in said inner cheek plate to thereby tend to maximize the length of the fuel flow path to facilitate upward movement of vapor bubbles as the fuel flows from the entrance to said inlet cavity to the passage in the second major side surface of said inner cheek plate, return passage means formed in said end section for receiving fuel from said inlet cavity at a second rate which is equal to the difference between said first rate and the rate at which fuel is discharged from said working chamber, said return passage means being connected in fluid communication with the source of fuel, and outlet passage means formed in said end section for receiving fuel discharged from said working chamber, said outlet passage means being connected in fluid communication with the engine operating chamber to enable fuel discharged from said working chamber of said pump means to be conducted to said engine operating chamber, said return passage means being connected in fluid communication with said inlet cavity at an upper portion of said inlet cavity, said inlet passage means being connected in fluid communication with said inlet cavity at a lower portion of said inlet cavity to enable vapor bubbles entrained in fuel introduced into said inlet cavity through said inlet passage to rise upwardly in said inlet cavity and to subsequently leave said inlet cavity with fuel flowing from said inlet cavity into said return passage means.

11. A pump and motor assembly as set forth in claim 10 further including screen means mounted on said second major side surface of said inner cheek plate and extending across the opening in said second major side surface of said inner cheek plate to block the flow of vapor bubbles into the passage in said inner cheek plate.

12. A pump and motor assembly as set forth in claim 11 wherein said screen means includes a frame disposed in sealing engagement with said second major side surface of said inner cheek plate and a fine mesh screen connected with said frame and extending along the second major side surface of said inner cheek plate.

13. A pump and motor assembly for use in regulating a flow of fuel from a source of fuel to an operating chamber of an engine of a vehicle, said pump and motor assembly comprising a casing forming a chamber with an opening at one end, said casing including an end wall and a tubular side wall connected with said end wall and having an open end portion opposite from said end wall, said tubular side wall being of a one-piece construction and having a length which is at least substantially as great as the length of said chamber, electric motor means disposed within said chamber for providing an output force upon transmittal of electric power to said electric motor means, said electric motor means including a stator fixedly connected with said casing and a rotatable armature circumscribed by said stator, said armature having an output end portion and a second end portion rotatably supported adjacent to said end wall of said casing with the axis of rotation of said armature coincident with a central axis of said tubular side wall of said casing, pump means disposed within said chamber in a coaxial relationship with said motor means for pumping fuel, said pump means including a cam ring, a rotor disposed within said cam ring and connected with said output end portion of said armature for rotation therewith about the central axis of said tubular side wall of said casing, a plurality of pumping connected with said rotor for rotation therewith, said pumping elements and cam ring cooperating to partially define a working chamber having an inlet area and an outlet area, said pump means further including an inner cheek plate disposed between said rotor and said electric motor means, said inner cheek plate cooperating with said rotor and cam ring to further define said working chamber, and an outer cheek plate disposed on a side of said rotor and cam ring opposite from said inner cheek plate, said outer cheek plate cooperating with said rotor and cam ring to still further define said working chamber, said pump and motor assembly further including an end section pump and motor assembly further including an end section fixedly connected across the open end of said tubular side wall of said casing, inlet passage means formed in said end section for receiving fuel from the source of fuel at a first rate which under at least some vehicle operating conditions exceeds the rate at which fuel is discharged from said working chamber, said end section at least partially defining an inlet cavity connected in fluid communication with said inlet area of said working chamber and said inlet passage means to enable said inlet cavity to receive fuel from said inlet passage means at said first rate, return passage means formed in said end section for receiving fuel from said inlet cavity at a second rate which is equal to the difference between said first rate and the rate at which fuel is discharged from said working chamber, said return passage means being connected in fluid communication with the source of fuel, and outlet passage means formed in said end section for receiving fuel discharged from said working chamber, said outlet passage means being connected in fluid communication with the engine operating chamber to enable fuel discharged from said working chamber of said pump means to be conducted to said engine operating chamber, said end section including surface means for at least partially defining an outlet cavity connected in fluid communication with the outlet area of said working chamber and in fluid communication with said outlet passage means, at least a portion of one of said inlet and outlet cavities having a circular cross sectional configuration and the other of said cavities having at least a portion with an annular configuration and circumscribing said circular portion of said one cavity, resiliently deflectable annular seal means disposed in engagement with said end section and said other cheek plate for blocking fluid flow between said inlet and outlet cavities and spring means disposed between said end section and said seal means for pressing said resiliently deflectable seal means into sealing engagement with said outer cheek plate, said spring means also being effective to press said outer cheek plate against said cam ring and to press said cam ring against said inner cheek plate.

14. A pump and motor assembly as set forth in claim 13 wherein said annular seal means is radially deflectable to at least partially absorb peak pressure pulses.

15. A pump and motor assembly for use in regulating a flow of fuel from a source of fuel to an operating chamber of an engine of a vehicle, said pump and motor assembly comprising a casing forming a chamber with an opening at one end, said casing including an end wall and a tubular side wall connected with said end wall and having an open end portion opposite from said end wall, said tubular side wall being of a one-piece construction and having a length which is at least substantially as great as the length of said chamber, electric motor means disposed within said chamber for providing an output force upon transmittal of electric power to said electric motor means, said electric motor means including a stator fixedly connected with said casing and a rotatable armature circumscribed by said stator, said armature having an output end portion and a second end portion rotatably supported adjacent to said end wall of said casing with the axis of rotation of said armature coincident with a central axis of said tubular side wall of said casing, pump means disposed with said chamber in a coaxial relationship with said motor means for pumping fuel, said pump means including a cam ring, a rotor disposed within said cam ring and connected with said output end portion of said armature for rotation therewith about the central axis of said tubular side wall of said casing, a plurality of pumping elements connected with said rotor for rotation therewith, said pumping elements and cam ring cooperating to partially define a working chamber having an inlet area and an outlet area, said rotor including means for defining a plurality of recesses in said rotor, each of said pumping elements being disposed in one of said recesses, said rotor further including means defining a plurality of passages in said rotor at a location radially inwardly of said recesses and extending between opposite major side surfaces of said rotor, said pump means further including an inner cheek plate disposed between said rotor and said electric motor means, said inner cheek plate cooperating with said rotor and cam ring to further define said working chamber, and an outer cheek plate disposed on a side of said rotor and cam ring opposite from said inner cheek plate, said outer cheek plate cooperating with said rotor and cam ring to still further define said working chamber, said pump and motor assembly further including an end section fixedly connected across the open end of said tubular side wall of said casing, inlet passage means formed in said end section for receiving fuel from the source of fuel at a first rate which under at least some vehicle operating conditions exceeds the rate at which fuel is discharged from said working chamber, said end section at least partially defining an inlet cavity connected in fluid communication with said inlet area of said working chamber and said inlet passage means to enable said inlet cavity to receive fuel from said inlet passage means at said first rate, said inlet cavity being connected to fluid communication with one major side of said rotor by a passage formed in said inner cheek plate, said inlet cavity being connected in fluid communication with the major side of said rotor opposite from said one major side along a flow path extending from the one major side of said rotor through said passages in said rotor, return passage means formed in said end section for receiving fuel from said inlet cavity at a second rate which is equal to the difference between said first rate and the rate at which fuel is discharged from said working chamber, said return passage means being connected in fluid communication with the source of fuel, and outlet passage means formed in said end section for receiving fuel discharged from said working chamber, said outlet passage means being connected in fluid communication with the engine operating chamber to enable fuel discharged from said working chamber of said pump means to be conducted to said engine operating chamber, said return passage means being connected in fluid communication with said inlet cavity at an upper portion of said inlet cavity, said inlet passage means being connected to fluid communication with said inlet cavity at a lower portion of said inlet cavity to enable vapor bubbles entrained in fuel introduced into said inlet cavity through said inlet passage to rise upwardly in said inlet cavity and to subsequently leave said inlet cavity with fuel flowing from said inlet cavity into said return passage means.

16. A pump and motor assembly for use in regulating a flow of fuel from a source of fuel to an operating chamber of an engine of a vehicle, said pump and motor assembly comprising a casing forming a chamber with an opening at one end, said casing including an end wall and a tubular side wall connected with said end wall and having an open end portion opposite from said end wall, said tubular side wall being of a one-piece construction and having a length which is at least substantially as great as the length of said chamber, electric motor means disposed within said chamber for providing an output force upon transmittal of electric power to said electric motor means, said electric motor means including a stator fixedly connected with said casing and a rotatable armature circumscribed by said stator, said armature having an output end portion and a second end portion rotatably supported adjacent to said end wall of said casing with the axis of rotation of said armature coincident with a central axis of said tubular side wall of said casing, pump means disposed within said chamber in a coaxial relationship with said motor means for pumping fuel, said pump means including a cam ring, a rotor disposed within said cam ring and connected with said output end portion of said armature for rotation therewith about the central axis of said tubular side wall of said casing, a plurality of pumping elements connected with said rotor for rotation therewith, said pumping elements and cam ring cooperating to partially define a working chamber having an inlet area and an outlet area, said rotor including means for defining a plurality of recesses in said rotor, each of said pumping elements being disposed in one of said recesses, said rotor further including means for defining a plurality of passages in said rotor at a location radially inwardly of said recesses and extending between opposite major side surfaces of said rotor, said pump means further including an inner cheek plate disposed between said rotor and said electric motor means, said inner cheek plate cooperating with said rotor and cam ring to further define said working chamber, and an outer cheek plate disposed on a side of said rotor and cam ring opposite from said inner cheek plate, said outer cheek plate cooperating with said rotor and cam ring to still further define said working chamber, said pump and motor assembly further including an end section fixedly connected across the open end of said tubular side wall of said casing, said end section being disposed in sealing engagement with said tubular side wall of said casing at a location which is spaced apart from said pump means, inlet passage means formed in said end section for receiving fuel from the source of fuel at a first rate which under at least some vehicle operating conditions exceeds the rate at which fuel is discharged from said working chamber, said end section cooperating with said tubular side wall of said casing to at least partially define an inlet cavity disposed between said tubular side wall and said pump means and connected in fluid communication with said inlet area of said working chamber and said inlet passage means to enable said inlet cavity to receive fuel from said inlet passage means at said first rate, said inlet cavity circumscribing said pump means and having an axial extent which is at least as great as the axial length of said pump means, said inlet cavity being connected in fluid communication with one major side of said rotor by a passage formed in said inner cheek plate, said inlet cavity being connected in fluid communication with the major side of said rotor opposite from said one major side along a flow path extending from the one major side of said rotor through said passages in said rotor, return passage means formed in said end section for receiving fuel from said inlet cavity at a second rate which is equal to the difference between said first rate and the rate at which fuel is discharged from said working chamber, said return passage means being connected in fluid communication with the source of fuel, and outlet passage means formed in said end section for receiving fuel discharged from said working chamber, said outlet passage means being connected to fluid communication with the engine operating chamber to enable fuel discharged from said working chamber of said pump means to be conducted to said engine operating chamber.

17. A pump and motor assembly as set forth in claim 16 wherein said cam ring and first and second cheek plates of said pump means are disposed inwardly of the open end portion of said tubular side wall of said casing so that said pump means is disposed entirely within said casing.

18. A pump and motor assembly as set forth in claim 16 wherein said return passage means is connected in fluid communication with said inlet cavity at an upper portion of said inlet cavity and said inlet passage means is connected in fluid communication with said inlet cavity at a lower portion of said inlet cavity to enable vapor bubbles entrained in fuel introduced into said inlet cavity from said inlet passage to rise upwardly in said inlet cavity and to subsequently leave said inlet cavity with fuel flowing from said inlet cavity into said return passage means.

19. A pump and motor assembly as set forth in claim 16 wherein said end section includes surface means for at least partially defining an outlet cavity connected in fluid communication with the outlet area of said working chamber and in fluid communication with said outlet passage means, at least a portion of one of said inlet and outlet cavities having a circular cross sectional configuration and the other of said cavities having at least a portion with an annular configuration and circumscribing said circular portion of said one cavity, and an annular seal means disposed in sealing engagement with said end section and said outer cheek plate for blocking fluid flow between said inlet and outlet cavities and a spring element pressing said seal means into sealing engagement with said outer cheek plate, said spring element being effective to press said outer cheek plate against said cam ring and to press said cam ring against said inner cheek plate.

20. A pump and motor assembly as set forth in claim 19 wherein said annular seal means includes means for at least partially absorbing peak pressure pulses.

21. A pump and motor assembly for use in regulating a flow of fuel from a source of fuel to an operating chamber of an engine of a vehicle, said pump and motor assembly comprising a casing forming a chamber with an opening at one end, said casing including an end wall and a tubular side wall connected with said end wall and having an open end portion opposite from said end wall, said tubular side wall being of a one-piece construction and having a length which is at least substantially as great as the length of said chamber, said tubular side wall including first and second sections interconnected by a transverse wall section, said first section of said tubular side wall at least partially defining a first portion of said chamber and having a first cross sectional area in a plane extending perpendicular to a longitudinal central axis of said tubular side wall, said second section of said tubular side wall at least partially defining a second portion of said chamber and having a second cross sectional area in a plane extending perpendicular to the longitudinal central axis of said tubular side wall, said second cross sectional area being greater than said first cross sectional area, electric motor means for providing an output force upon transmittal of electric power to said electric motor means, said electric motor means being disposed in said first portion of said chamber and including a stator connected with said first section of said tubular side wall and a rotatable armature circumscribed by said stator, said armature having an output end portion extending into said second portion of said chamber and a second end portion rotatably supported adjacent to said end wall of said casing, pump means for pumping fuel, said pump means being disposed in abutting engagement with said transverse wall section of said tubular side wall to locate said pump means in said chamber, said pump means being disposed within said second portion of said chamber in a coaxial relationship with said motor means, said pump means including a cam ring, a rotor disposed within said cam ring and connected with said output end portion of said armature for rotation therewith about the longitudinal central axis of said tubular side wall of said casing, a plurality of pumping elements connected with said rotor for rotation therewith, said pumping elements and cam ring cooperating to partially define a working chamber having an inlet area and an outlet area, said rotor including means for defining a plurality of recesses in said rotor, each of said pumping elements being disposed in one of said recesses, said rotor further including means for defining a plurality of passages in said rotor at a location radially inwardly of said recesses and extending between opposite major side surfaces of said rotor, said pump means further including an inner cheek plate disposed between said rotor and said electric motor means, said inner cheek plate cooperating with said rotor and cam ring to further define said working chamber, and an outer cheek plate disposed on a side of said rotor and cam ring opposite from said inner cheek plate, said outer cheek plate cooperating with said rotor and cam ring to still further define said working chamber, said pump and motor assembly further including an end section fixedly connected across the open end of said tubular side wall of said casing, said end section being disposed in sealing engagement with an end portion of said second section of said second section of said tubular side wall at a location spaced apart from said pump means, inlet passage means for receiving fuel from the source of fuel, said end section and said second section of said side wall cooperating to at least partially define an inlet cavity connected in fluid communication with said inlet area of said working chamber and said inlet passage means to enable said inlet cavity to receive fuel from said inlet passage means at said first rate, said inlet cavity circumscribing said pump means and extending between said end section and said transverse wall section of said tubular side wall, said inlet cavity being connected in fluid communication with one major side of said rotor by a passage formed in said inner cheek plate, said inlet cavity being connected in fluid communication with the major side of said rotor opposite from said one major side along a flow path extending from the one major side of said rotor through said passages in said rotor, and outlet passage means for receiving fuel discharged from said working chamber, said outlet passage means being connected to fluid communication with the engine operating chamber to enable fuel discharged from said working chamber of said pump means to be conducted to said engine operating chamber.

22. A pump and motor assembly for use in regulating a flow of fuel from a source of fuel to an operating chamber of an engine of a vehicle, said pump and motor assembly comprising a casing forming a chamber with an opening at one end, said casing including an end wall and a tubular side wall connected with said end wall and having an open end portion opposite from said end wall, said tubular side wall being of a one-piece construction and having a length which is at least substantially as great as the length of said chamber, said tubular side wall including first and second sections interconnected by a transverse wall section, said first section of said tubular side wall having a first cross sectional area in a plane extending perpendicular to a longitudinal central axis of said tubular side wall, said second section of said tubular side wall having a second cross sectional area in a plane extending perpendicular to the longitudinal central axis of said tubular side wall, said second cross sectional area being greater than said first cross sectional area, electric motor means disposed within said first section of said tubular side wall for providing an output force upon transmittal of electric power to said electric motor means, said electric motor means including a stator connected with said casing and a rotatable armature circumscribed by said stator, said armature having an output end portion and a second end portion rotatably supported adjacent to said end wall of said casing with the axis of rotation of said armature coincident with the longitudinal central axis of said tubular side wall of said casing, pump means disposed within said second section of said tubular side wall in a coaxial relationship with said motor means for pumping fuel, said pump means including a cam ring, a rotor disposed within said cam ring and connected with said output end portion of said armature for rotation therewith about the central axis of said tubular side wall of said casing, a plurality of pumping elements connected with said rotor for rotation therewith, said pumping elements and cam ring cooperating to partially define a working chamber having an inlet area and an outlet area, said pump means further including an inner cheek plate disposed between said rotor and said electric motor means, said inner cheek plate being disposed in abutting engagement with said transverse wall section of said tubular side wall to locate said pump means axially in said chamber, said inner cheek plate cooperating with said rotor and cam ring to further define said working chamber, said inner cheek plate having a first major side surface disposed in abutting engagement with said cam ring and a second major side surface disposed in abutting engagement with said transverse wall section of said tubular side wall, said inner cheek plate having surface means at least partially defining a passage extending through said inner cheek plate at a location spaced apart from a minor side surface of said inner cheek plate, said passage having openings in said first and second major side surfaces of said inner cheek plate at locations spaced apart from the minor side surface of said inner cheek plate, and an outer cheek plate disposed on a side of said rotor and cam ring opposite from said inner cheek plate, said outer cheek plate cooperating with said rotor and cam ring to still further define said working chamber, said pump and motor assembly further including an end section fixedly connected across the open end of said tubular side wall of said casing, said end section being disposed in sealing engagement with an end portion of said second section of said tubular side wall, inlet passage means formed in said end section for receiving fuel from the source of fuel at a first rate which under at least some vehicle operating conditions exceeds the rate at which fuel is discharged from said working chamber, said end section at least partially defining an inlet cavity connected in fluid communication with said inlet area of said working chamber and said inlet passage means to enable said inlet cavity to receive fuel from said inlet passage means at said first rate, said inlet cavity extending between said end section and said transverse wall section of said tubular side wall, said inlet cavity being connected in fluid communication with said inlet passage means at a location adjacent to said outer cheek plate and being connected in fluid communication with said inlet area of said working chamber by a fluid flow path which enters the passage in said inner cheek plate at the opening in said second major side surface of said inner cheek plate so that fuel enters said inlet cavity at one end of said pump means and flows from said one end of said pump means to the opposite end of said pump means before entering the passage in said inner cheek plate, return passage means formed in said end section for receiving fuel from said inlet cavity at a second rate which is equal to the difference between said first rate and the rate at which fuel is discharged from said working chamber, said return passage means being connected in fluid communication with the source of fuel, and outlet passage means formed in said end section for receiving fuel discharged from said working chamber, said outlet passage means being connected in fluid communication with the engine operating chamber to enable fuel discharged from said working chamber of said pump means to be conducted to said engine operating chamber.

23. A pump and motor assembly as set forth in claim 22 wherein said cam ring and first and second cheek plates of said pump means are disposed within and are spaced apart from said second section of said tubular side wall, said inlet cavity extending around said pump means and being disposed between said pump means and said second section of said tubular side wall.

24. A pump and motor assembly as set forth in claim 22 wherein said inlet cavity circumscribes said pump means and has an axial extent which is at least as great as the axial length of said pump means and is at least coextensive therewith.

25. A pump and motor assembly as set forth in claim 24 wherein said return passage means is connected in fluid communication with said inlet cavity at an upper portion of said inlet cavity and said inlet passage means is connected in fluid communication with said inlet cavity at a lower portion of said inlet cavity to enable vapor bubbles entrained in fuel introduced into said inlet cavity from said inlet passage to rise upwardly in said inlet cavity and to subsequently leave said inlet cavity with fuel flowing from said inlet cavity into said return passage means.

26. A pump and motor assembly as set forth in claim 22 further including an outlet cavity at least partially defined by said end section and connected in fluid communication with said outlet area of said working chamber and with said outlet passage means, said inlet and outlet cavities being disposed in a coaxial relationship with each other and with the central axis of said tubular side wall of said casing.

27. A pump and motor assembly as set forth in claim 22 wherein said end section includes surface means for at least partially defining an outlet cavity connected in fluid communication with the outlet area of said working chamber and in fluid communication with said outlet passage means, at least a portion of one of said inlet and outlet cavities having a circular cross sectional configuration and the other of said cavities having at least a portion with an annular configuration and circumscribing said circular portion of said one cavity.

28. A pump and motor assembly as set forth in claim 27 further including resiliently deflectable annular seal means for blocking fluid flow between said inlet and outlet cavities and a spring element pressing said resiliently deflectable seal means into sealing engagement with said outer cheek plate, said spring element being effective to press said outer cheek plate against said cam ring and to press said cam ring against said inner cheek plate.

29. A pump and motor assembly as set forth in claim 28 wherein said seal means includes annular wall means which is radially deflectable to at least partially absorb peak pressure pulses.

30. A pump and motor assembly as set forth in claim 22 further including a plurality of recesses formed in said rotor, each of said pumping elements being disposed in one of said recesses, said pump and motor assembly further including a plurality of passages formed in said rotor at a location radially inwardly of said recesses and extending between opposite major side surfaces of said rotor, said inlet cavity being connected in fluid communication with one major side of said rotor by a passage formed in said inner cheek plate, said inlet cavity being connected in fluid communication with the major side of said rotor opposite from said one major side along a flow path extending from the one major side of said rotor through said passages in said rotor.

31. A pump and motor assembly as set forth in claim 22 wherein said return passage means is connected in fluid communication with an upper portion of said inlet cavity and said inlet passage means is connected in fluid communication with a lower portion of said inlet cavity to enable vapor bubbles entrained in the fuel to move upwardly toward said return passage means as fuel flows from said inlet passage means through said inlet cavity to the passage in said inner cheek plate.

32. A pump and motor assembly as set forth in claim 31 further including screen means extending across the openings in said second major side surface of said inner cheek plate for promoting the separation of vapor bubbles from the fuel prior to movement of the fuel into said passage in said inner cheek plate.

33. A pump and motor assembly for use in regulating a flow of fuel from a source of fuel to an operating chamber of an engine of a vehicle, said pump and motor assembly comprising a casing forming a chamber with an opening at one end, said casing including an end wall and a tubular side wall connected with said end wall and having an open end portion opposite from said end wall, said tubular side wall being of a one-piece construction and having a length which is at least substantially as great as the length of said chamber, said tubular side wall including first and second sections interconnected by a transverse wall section, said first section of said tubular side wall at least partially defining a first portion of said chamber and having a first cross sectional area in a plane extending perpendicular to a longitudinal central axis of said tubular side wall, said second section of said tubular side wall at least partially defining a second portion of said chamber and having a second cross secional area in a plane extending perpendicular to the longitudinal central axis of said tubular side wall, said second cross sectional area being greater than said first cross sectional area, electric motor means for providing an output force upon transmittal of electric power to said electric motor means, said electric motor means being disposed in said first portion of said chamber and including a stator connected with said first section of said tubular side wall and a rotatable armature circumscribed by said stator, said armature having an output end portion extending into said second portion of said chamber and a second end portion rotatably supported adjacent to said end wall of said casing, pump means for pumping fuel, said pump means being disposed in abutting engagement with said transverse wall section of said tubular side wall to locate said pump means in said chamber, said pump means being disposed within said second portion of said chamber in a coaxial relationship with said motor means, said pump means including a cam ring, a rotor disposed within said cam ring and connected wih said output end portion of said armature for rotation therewith about the longitudinal central axis of said tubular side wall of said casing, a plurality of pumping elements connected with said rotor for rotation therewith, said pumping elements and cam ring cooperating to partially define a working chamber having an inlet area and an outlet area, said pump means further including an inner cheek plate disposed between said rotor and said electric motor means, said inner cheek plate cooperating with said rotor and cam ring to further define said working chamber, said inner cheek plate including surface means at least partially defining a passage extending through said inner cheek plate and having openings in a first major side surface disposed adjacent to said cam ring and a second major side surface disposed opposite from said first major side surface, said second major side surface of said cheek plate being disposed in abutting engagement with said transverse wall section, and an outer cheek plate disposed on a side of said rotor and cam ring opposite from said inner cheek plate, said outer cheek plate cooperating with said rotor and cam ring to still further define said working chamber, said pump and motor assembly further including an end section fixedly connected across the open end of said tubular side wall of said casing, said end section being disposed in sealing engagement with an end portion of said second section of said tubular side wall at a location spaced apart from said pump means, inlet passage means for receiving fuel from the source of fuel, said end section and said second section of said side wall cooperating to at least partially define an inlet cavity connected in fluid communication with said inlet area of said working chamber and said inlet passage means to enable said inlet cavity to receive fuel from said inlet passage means at said first rate, said inlet cavity circumscribing said pump means and extending between said end section and said transverse wall section of said tubular side wall, said inlet cavity being connected in fluid communication with said inlet passage means at a location adjacent to said outer cheek plate and being connected in fluid communication with said inlet area of said working chamber by a fluid flow path which enters the passage in said inner cheek plate at the opening in said second major side surface of said inner cheek plate so that fuel enters said inlet cavity at one end of said pump means and flows from said one end of said pump means to the opposite end of said pump means before entering the passage in said inner cheek plate, and outlet passage means for receiving fuel discharged from said working chamber, said outlet passage means being connected in fluid communication with the engine operating chamber to enable fuel discharged from said working chamber of said pump means to be conducted to said engine operating chamber.

34. A pump and motor assembly as set forth in claim 33 further including screen means extending across the opening in said second major side surface of sid inner cheek plate for promoting the separation of vapor bubbles from the fuel prior to movement of the fuel into said passage in said inner cheek plate.

35. A pump and motor assembly as set forth in claim 34 wherein said screen means includes a screen having a flat side surface which extends along the second major side surface of said inner cheek plate in a direction perpendicular to the axis of rotation of said rotor.

36. A pump and motor assembly as set forth in claim 34 wherein said screen means includes a frame disposed in engagement with said second major side of said inner cheek plate and a screen element connected with and at least partially supported by said frame.

37. A pump and motor assembly as set forth in claim 33 wherein said second section of said tubular side wall circumscribes said pump means and is spaced apart from said pump means, said inlet cavity being disposed in the space between said pump means and said second section of said tubular side wall.

38. A pump and motor assembly as set forth in claim 33 further including an outlet cavity at least partially defined by said end section and connected in fluid communication with said outlet area of said working chamber and with said outlet passage means, said inlet and outlet cavities being disposed in a coaxial relationship with each other and with the longitudinal central axis of said tubular side wall of said casing.

39. A pump and motor assembly for use in regulating a flow of fuel from a source of fuel to an operating chamber of an engine of a vehicle, said pump and motor assembly comprising a casing having an opening at one end, electric motor means disposed within said casing for providing an output force upon transmittal of electrical power to said electric motor means, said electric motor means including a stator fixedly connected with said casing and a rotatable armature circumscribed by said stator and having an output end portion, pump means disposed within said chamber in a coaxial relationship with said motor means for pumping fuel, said pump means including a cam ring, a rotor disposed within said cam ring and connected with said output end portion of said armature for rotation therewith, a plurality of pumping elements connected with said rotor for rotation therewith, said pumping elements and cam ring cooperating to partially define a working chamber having an inlet area and an outlet area, said pump means further including an inner cheek plate disposed between said rotor and said electric motor means, said inner cheek plate cooperating with said rotor and cam ring to further define said working chamber, and an outer cheek plate disposed on a side of said rotor and cam ring opposite from said inner cheek plate, said outer cheek plate cooperating with said rotor and cam ring to still further define said working chamber, said pump and motor assembly further including an end section fixedly connected across the open end of said casing, inlet passage means for receiving fuel from the source of fuel, said end section at least partially defining an inlet cavity connected in fluid communication with said inlet area of said working chamber and said inlet passage means to receive fuel from said inlet passage means, outlet passage means for receiving fuel discharged from said working chamber, said outlet passage means being connected in fluid communication with the engine operating chamber to enable fuel discharged from said working chamber of said pump means to be conducted to said engine operating chamber, said end section at least partially defining an outlet cavity connected in fluid communication with said outlet area of said working chamber and said outlet passage means to receive fuel discharged from said working chamber, and seal and pressure pulse dampening means disposed between said end section and pump means for preventing fluid flow between said inlet and outlet cavities and for at least partially dampening pressure pulses in fuel discharged from said working chamber, said seal and pressure pulse dampening means including a resilient member disposed in sealing engagement with said end section and said outer cheek plate to block fluid communication between said inlet an outlet cavities and spring means disposed between said resilient member and said end section for pressing said resilient member into tight sealing engagement with said outer cheek plate, for pressing said outer cheek plate against said cam ring and for pressing said cam ring against said inner cheek plate, said resilient member being resiliently flexible in a direction toward said inlet cavity under the influence of fluid pressure pulses in said outlet cavity to at least partially dampen the fluid pressure pulses.

40. A pump and motor assembly as set forth in claim 39 further including a plurality of recesses formed in said rotor, each of said pumping elements being disposed in one of said recesses, a plurality of passages formed in said rotor at a location radially inwardly of said recesses and extending between opposite major side surfaces of said rotor, said inlet cavity being connected in fluid communication with one major side of said rotor by a passage formed in said inner cheek plate, said inlet cavity being connected in fluid communication with the major side of said rotor opposite from said one major side along a flow path extending from the one major side of said rotor through said passages in said rotor.

41. A pump and motor assembly for use in regulating a flow of fuel from a source of fuel to an operating chamber of an engine of a vehicle, said pump and motor assembly comprising a housing assembly, electric motor means disposed within said housing assembly for providing an output force upon transmittal of electrical power to said electric motor means, said electric motor means including a stator fixedly connected with said housing assembly and a rotatable armature circumscribed by said stator and having an output end portion, pump means disposed within said housing assembly for pumping fuel, said pump means including a cam ring, a rotor disposed within said cam ring and connected with said output end portion of said armature for rotation therewith, a plurality of pumping elements connected with said rotor for rotation therewith, said pumping elements and cam ring cooperating to partially define a working chamber having an inlet area and an outlet area, said pump means further including an inner cheek plate disposed between said rotor and said electric motor means, said inner cheek plate cooperating with said rotor and cam ring to further define said working chamber, said inner cheek plate having surface means at least partially defining a passage extending through said inner cheek plate and having openings in a first major side of said inner cheek plate adjacent to said cam ring and a second major side disposed opposite from said first major side, and an outer cheek plate disposed on a side of said rotor and cam ring opposite from said inner cheek plate, said outer cheek plate cooperating with said rotor and cam ring to still further define said working chamber, said pump and motor assembly further including inlet passage means for receiving fuel from the source of fuel at a first rate which under at least some vehicle operating conditions exceeds the rate at which fuel is discharged from said working chamber, an inlet cavity disposed within said housing assembly and circumscribing said pump means and having an axial extent which is at least as great as the axial extent of said pump means, said inlet cavity being connected in fluid communication with said inlet area of said working chamber and said inlet passage means to enable said inlet cavity to receive fuel from said inlet passage means at said first rate, said inlet cavity being connected in fluid communication with said inlet passage means at a location adjacent to said outer cheek plate and being connected in fluid communication with said inlet area of said working chamber by a fluid flow path which enters the passage in said inner cheek plate at the opening in said second major side of said inner cheek plate so that fuel enters said inlet cavity at one end of said pump means and flows from said one end of said pump means to the opposite end of said pump means before entering the passage in said inner cheek plate, return passage means for receiving fuel from said inlet cavity at a second rate which is equal to the difference between said first rate and the rate at which fuel is discharged from said working chamber, said return passage means being connected in fluid communication with the source of fuel and being connected in fluid communication with an upper portion of said inlet cavity, said inlet passage means being connected in fluid communication with a lower portion of said inlet cavity to enable vapor bubbles entrained in the fuel to move upwardly toward said return passage means as fuel flows from said inlet passage means through said inlet cavity to the passage in said inner cheek plate, screen means mounted on said second major side of said inner cheek plate and extending across the opening in said second major side of said inner cheek plate to block the flow of vapor bubbles from said inlet cavity into the passage in said inner cheek plate, and outlet passage means for receiving fuel discharged from said working chamber, said outlet passage means being connected in fluid communication with the engine operating chamber to enable fuel discharged from said working chamber of said pump means to be conducted to said engine operating chamber.

42. A pump and motor assembly as set forth in claim 41 wherein said screen means includes a screen having a flat side surface which extends along the second major side of said inner cheek plate in a direction perpendicular to the axis of rotation of said rotor.

43. A pump and motor assembly as set forth in claim 41 wherein said screen means includes a frame disposed in engagement with said second major side of said inner cheek plate and a screen element connected with and at least partially supported by said frame.

44. A pump and motor assembly for use in regulating a flow of fuel from a source of fuel to an operating chamber of an engine of a vehicle, said pump and motor assembly comprising a housing assembly, electric motor means disposed within said housing assembly for providing an output force upon transmittal of electrical power to said electric motor means, said electric motor means including a stator fixedly connected with said housing assembly and a rotatable armature circumscribed by said stator and having an output end portion, pump means disposed within said housing assembly for pumping fuel, said pump means including a cam ring, a rotor disposed within said cam ring and connected with said output end portion of said armature for rotation therewith, said rotor including first surface means for defining a plurality of radially outwardly opening recesses in said rotor and second surface means for defining a plurality of passages extending between opposite major side surfaces of said rotor at locations spaced apart from said recesses, a plurality of pumping elements each of which is disposed in one of said recesses in said rotor, said pumping elements and cam ring cooperating to partially define a working chamber having an inlet area and an outlet area, said pump means further including an inner cheek plate disposed between said rotor and said electric motor means, said inner cheek plate cooperating with said rotor and cam ring to further define said working chamber, and an outer cheek plate disposed on a side of said rotor and cam ring opposite from said inner cheek plate, said outer cheek plate cooperating with said rotor and cam ring to still further define said working chamber, said pump and motor assembly further including inlet passage means for receiving fuel from the source of fuel, an inlet cavity disposed within said housing assembly and connected in fluid communication with said inlet area of said working chamber and said inlet passage means to enable said inlet cavity to receive fuel from said inlet passage means, said inlet cavity being connected in fluid communication with said plurality of passages in said rotor to enable fuel to flow from said inlet cavity to opposite sides of said rotor through said passages, and outlet passage means for receiving fuel discharged from said working chamber, said outlet passage means being connected in fluid communication with the engine operating chamber to enable fuel discharged from said working chamber of said pump means to be conducted to said engine operating chamber.

45. A pump and motor assembly as set forth in claim 44 wherein said inner cheek plate has surface means at least partially defining a plurality of passages having inlet end portions connected in fluid communication with said inlet cavity and outlet end portions connected in fluid communication with said inlet area of said working chamber and said passages in said rotor.

46. A pump and motor assembly as set forth in claim 45 wherein said inner cheek plate has a first major side disposed in abutting engagement with said cam ring and a second major side opposite from said first major side, said inlet end portions of said passages in said inner cheek plate having openings in said second major side of said cheek plate, said outlet end portions of said passage in said inner cheek plate having openings in said first major side of said inner cheek plate.

47. A pump and motor assembly as set forth in claim 46 further including screen means mounted on said second major side of said inner cheek plate and extending across said inlet end portions of said passages in said inner cheek plate for promoting the separating of vapor bubbles from the fuel prior to movement of the fuel into said passages in said inner cheek plate.

48. A pump and motor assembly as set forth in claim 47 wherein said screen means includes a screen disposed adjacent to said second major side of said inner cheek plate and having a flat side surface which extends perpendicular to the axis of rotation of said rotor.

49. A pump and motor assembly as set forth in claim 41 wherein said screen means includes a frame disposed in engagement with said second major side of said inner cheek plate and a screen element connected with and at least partially supported by said frame.

* * * * *

UNITED STATES PATENT AND TRADEMARK OFFICE

CERTIFICATE OF CORRECTION

PATENT NO. : 4,207,033

DATED : June 10, 1980

INVENTOR(S) : Gilbert H. Drutchas et al.

It is certified that error appears in the above–identified patent and that said Letters Patent are hereby corrected as shown below:

Column 16, line 24, after "an" insert --output--.
Column 18, line 4, after "pumping" insert --elements--.
Column 18, lines 17 and 18, delete "pump and motor assembly further including an end section".
Column 19, line 50, change "to" to --in--.
Column 20, line 4, change "to" to --in--.
Column 21, line 21,change "to" to --in--.
Column 22, line 58, after "section" delete --of said second section--.
Column 23, line 10, change "to" to --in--.
Column 23, line 38, after "stator" insert --fixedly--.
Column 26, line 15, change "secional" to --sectional--.
Column 26, line 35, change "wih" to --with--.
Column 27, line 24, change "sid" to --said--.
Column 27, line 31, change "peri-" to --per- --.
Column 31, line 14, change "separating" to --separation--.

Signed and Sealed this

*Twenty-eighth* Day of *October 1980*

[SEAL]

*Attest:*

SIDNEY A. DIAMOND

*Attesting Officer*

*Commissioner of Patents and Trademarks*